US010570693B2

(12) United States Patent
Moyes

(10) Patent No.: US 10,570,693 B2
(45) **Date of Patent: *Feb. 25, 2020**

(54) APPARATUS FOR USE IN A FLUID CONDUIT

(71) Applicant: XTREME WELL TECHNOLOGY LIMITED, Kintore (GB)

(72) Inventor: Peter B. Moyes, Kintore (GB)

(73) Assignee: XTREME WELL TECHNOLOGY LIMITED, Kintore (GB)

( * ) Notice: Subject to any disclaimer, the term of this patent is extended or adjusted under 35 U.S.C. 154(b) by 0 days.

This patent is subject to a terminal disclaimer.

(21) Appl. No.: 15/919,080

(22) Filed: Mar. 12, 2018

(65) Prior Publication Data

US 2018/0202256 A1 Jul. 19, 2018

Related U.S. Application Data

(63) Continuation of application No. 14/361,828, filed as application No. PCT/GB2012/052970 on Nov. 30, 2012, now Pat. No. 9,915,119.

(30) Foreign Application Priority Data

Dec. 1, 2011 (GB) ..... 1120713.1

(51) Int. Cl.
*E21B 33/10* (2006.01)
*E21B 33/128* (2006.01)
(Continued)

(52) U.S. Cl.
CPC ..... *E21B 33/10* (2013.01); *E21B 23/01* (2013.01); *E21B 33/1208* (2013.01); *E21B 33/128* (2013.01); *E21B 33/129* (2013.01)

(58) Field of Classification Search
CPC .. E21B 33/128; E21B 33/129; E21B 33/1208; E21B 33/10; E21B 33/134; E21B 23/06
See application file for complete search history.

(56) References Cited

U.S. PATENT DOCUMENTS 49,599 A 8/1865 Sicouret
250,929 A 12/1881 Lewis
(Continued)

FOREIGN PATENT DOCUMENTS

EP 0141726 A2 * 5/1985 ..... E21B 33/1216
WO WO 02/04783 A1 1/2002
(Continued)

OTHER PUBLICATIONS

Jan. 3, 2014 International Search Report & Written Opinion issued in PCT/GB2012/052970.
(Continued)

*Primary Examiner* — Jennifer H Gay
(74) *Attorney, Agent, or Firm* — Eileen Pape

(57) ABSTRACT

An apparatus for use in a fluid conduit comprises a plurality of segments arranged along a longitudinal axis, each segment comprising an extendable structure configured for extension in a lateral direction relative to the longitudinal axis, wherein the apparatus is configured for the sequential initiation of lateral extension of the extendable structures of at least two segments. At least two segments may be configured to define different maximum extended dimensions in the lateral direction and may include adjacent support surfaces which provide mutual support for one another when the at least two segments are laterally extended. The apparatus may be configured to form a seal, an anchor, a supporting structure and/or a flow restriction in a fluid conduit.

20 Claims, 19 Drawing Sheets

(51) Int. Cl.

| | |
|---|---|
| ***E21B 33/129*** | (2006.01) |
| ***E21B 23/01*** | (2006.01) |
| ***E21B 33/12*** | (2006.01) |

(56) References Cited

U.S. PATENT DOCUMENTS

| | | | | |
|---|---|---|---|---|
| 266,848 | A | 10/1882 | Lewis | |
| 3,706,342 | A | 12/1972 | Woolley | |
| 3,784,214 | A | 1/1974 | Tamplen | |
| 4,441,721 | A | 4/1984 | Harris | |
| 4,554,973 | A | 11/1985 | Shonrock | |
| RE32,831 | E | 1/1989 | Shonrock | |
| 6,182,755 | B1 | 2/2001 | Mansure | |
| 6,318,461 | B1 | 11/2001 | Carisella | |
| 6,782,946 | B2 | 8/2004 | Perkins | |
| 6,896,049 | B2 | 5/2005 | Moyes | |
| 7,559,364 | B2 | 7/2009 | Bullard | |
| 7,588,077 | B2 | 9/2009 | Bullard | |
| 7,757,756 | B2 | 7/2010 | Bullard | |
| 8,443,907 | B2 | 5/2013 | Mickey | |
| 9,140,095 | B2 | 9/2015 | Northam | |
| 9,145,755 | B2 | 9/2015 | Farquhar | |
| 9,915,119 | B2 * | 3/2018 | Moyes | E21B 33/10 |
| 2003/0066640 | A1 | 4/2003 | Perkins | |
| 2003/0184178 | A1 | 10/2003 | Bousche | |
| 2003/0217844 | A1 | 11/2003 | Moyes | |
| 2004/0069502 | A1 | 4/2004 | Luke | |
| 2004/0182582 | A1 | 9/2004 | Bosma | |
| 2008/0066902 | A1 | 3/2008 | Bullard | |
| 2008/0224085 | A1 | 9/2008 | Coull | |
| 2009/0173489 | A1 | 7/2009 | Bullard | |
| 2009/0205817 | A1 | 8/2009 | Gustafson | |
| 2009/0242189 | A1 | 10/2009 | Vaidya | |
| 2011/0303421 | A1 | 12/2011 | Mickey | |
| 2012/0273236 | A1 | 11/2012 | Gandikota | |
| 2014/0318812 | A1 | 10/2014 | Moyes | |
| 2018/0202256 | A1 * | 7/2018 | Moyes | E21B 33/10 |

FOREIGN PATENT DOCUMENTS

| | | | |
|---|---|---|---|
| WO | WO 02/16729 | A1 | 2/2002 |
| WO | WO 2008/112333 | A1 | 9/2008 |
| WO | WO 2012/149224 | A2 | 11/2012 |

OTHER PUBLICATIONS

International Search Report and Written Opinion issued in the counterpart PCT Application PCT/GB2012/052970, dated Jan. 3, 2014 (10 pages).

International Preliminary Report on Patentability Issued in the counterpart PCT Application PCT/GB2012/052970, dated Jun. 3, 2014 (6 pages).

Examination report issued in the counterpart AU Application 2012343522, dated Aug. 11, 2016 (3 pages).

Examination report issued in the counterpart AU Application 2017213504, dated Jul. 31, 2018 (4 pages).

Notice of Acceptance issued in the counterpart AU Application 2017213504, dated Apr. 15, 2019 (4 pages).

Search Report issued in the counterpart GB Application 1120713.1, dated Jan. 6, 2012 (4 pages).

Examination Report issued in the counterpart GB Application 1120713.1, dated Mar. 2, 2018 (4 pages).

Examination Report issued in the counterpart GB Application 1120713.1, dated Sep. 24, 2018 (3 pages).

Examination Report issued in the counterpart CA Application 2857578, dated Oct. 1, 2018 (4 pages).

Examination Report issued in the counterpart CA Application 2857578, dated Jun. 17, 2019 (4 pages).

* cited by examiner

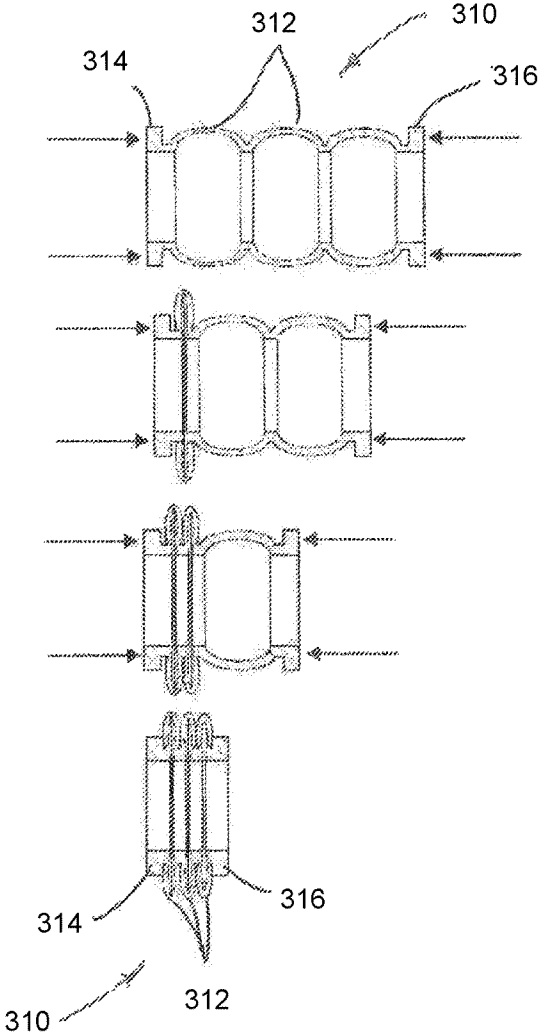
Figure 6(a)
Figure 6(b)
Figure 6(c)
Figure 6(d)
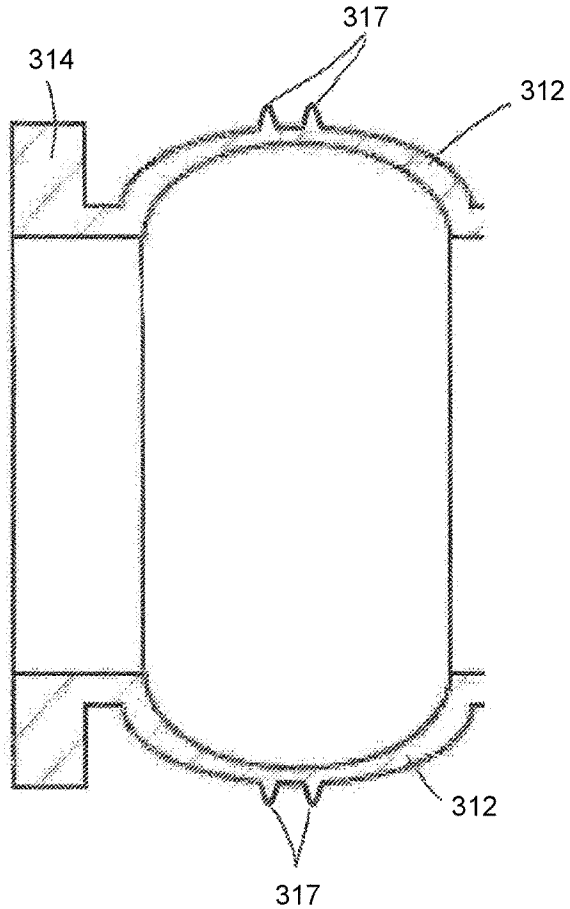
Figure 6(e)

APPARATUS FOR USE IN A FLUID CONDUIT

This application is a continuation of U.S. application Ser. No. 14/361,828, filed May 30, 2014, now issued as U.S. Pat. No. 9,915,119, which is the U.S. national phase of International Application No. PCT/GB2012/052970 filed Nov. 30, 2012, which claims priority to GB Patent Application No. 1120713.1 filed Dec. 1, 2011, the entire contents of each of which are hereby incorporated by reference.

FIELD OF THE INVENTION

The present invention relates to an apparatus for use in a fluid conduit such as a wellbore, pipeline or the like, and in particular, but not exclusively, to an apparatus for providing a sealing, anchoring, support and/or flow restriction function within a fluid conduit.

BACKGROUND TO THE INVENTION

Typical system architecture and procedures within the oil and gas industry may require operations to be performed within fluid conduits such as pipelines and wellbores, for example open hole wellbores or wellbore tubulars. For example, seals are frequently used to seal a fluid conduit, or a region such as an annular region defined within the fluid conduit, for zonal isolation, to establish a desired pressure for tool setting or the like. Such seals may be provided by packers, such as mechanical packers, inflatable packers, swellable packers or the like. Bridge plug and straddle tools may also include such seals. Furthermore, it is known to use anchors such as mechanical anchors within a fluid conduit to secure a component within the fluid conduit.

In most cases, equipment for use in performing operations in fluid conduits, such as packers, bridge plugs, straddles, anchors and the like, must be run into the fluid conduit while in a configuration which defines a minimal outer dimension to prevent snagging within the fluid conduit and permit passage through any fluid conduit restrictions. Such equipment must be capable of being reconfigured to define a larger dimension once at a desired position within the fluid conduit, for example to engage a fluid conduit wall for sealing or anchoring purposes, to actuate another tool or the like. However, high expansion ratios are difficult to achieve, and it is well known in the art that excessive expansion ratios are typically only achievable at the expense of performance. For example, a highly expanded seal may perform poorly against high pressures and may be susceptible to axial leakage and extrusion. Furthermore, a highly expanded anchor may be incapable of providing adequate gripping force.

Depending on environmental conditions, conventional seals may also be susceptible to failure even at low or zero expansion ratios. For example, conventional elastomer seals may be susceptible to extrusion at high pressures even at low or zero expansion ratios. Furthermore, when used in high pressure environments, conventional elastomer seals may become saturated with fluid and may be susceptible to failure by explosive decompression. Other known failure modes of conventional elastomer seals include temperature and chemical degradation. To mitigate at least some of these problems, it is known to reinforce conventional elastomer seals, for example, using metal such as wire mesh. However, even reinforced elastomer seals may be inadequate for some applications.

US 2003/0066640 discloses a known apparatus for injecting the fluid into a borehole. The apparatus includes a body adapted for passage through a borehole, at least four radially extendable and retractable zone interface elements spaced longitudinally along the body which when extended define at least three zones along the body, a zone interface element actuator for selectively extending and retracting the zone interface elements, and a fluid delivery system for delivering the fluid to each zone.

U.S. Pat. No. 6,182,755 discloses an annular seal made of a collapsible bellows. The bellows is expanded for insertion to reduce its outer dimension and sets by compaction as a result of relative movement. The bellows can be straight or tapered.

US 2009/0205817 discloses a packer assembly comprising a tubular member and a packer system circumferentially overlies the tubular member. The packer system includes end portions and the central portion disposed between the end portions. The central portion and the end portions are formed of material that swells when contacted with a swelling fluid. The central and end portions are constructed to swell upon contact with the swelling fluid so that the central portion swells to a diameter defined by a wall of the wellbore more rapidly than the end portions. In such a configuration, the central portion of the packer system can be fully swollen prior to the full swelling of the end portions.

US 2009/0242189 discloses our swell packer including a base tubular, a seal member encircling the base tubular, the seal member swelling radially to a seal equilibrium swell upon contact with particular fluid, and a disc positioned about the base tubular substantially abutting an end of the seal member but not physically connected to the seal member in a manner that limits the equilibrium swell of the seal member, the disc swelling radially to a first equilibrium swell upon contact with a particular fluid.

SUMMARY OF THE INVENTION

According to a first aspect of the present invention there is provided an apparatus for use in a fluid conduit, the apparatus comprising a plurality of segments arranged along a longitudinal axis, each segment comprising an extendable structure configured for extension in a lateral direction relative to the longitudinal axis, wherein the apparatus is configured for the sequential initiation of lateral extension of the extendable structures of at least two segments.

The apparatus may be configured to provide a sealing, anchoring, support and/or flow restriction function within a fluid conduit. Such an apparatus may be less susceptible to known limitations of conventional sealing, anchoring, support and/or flow restriction devices.

The apparatus may be configured for use within a tubular.

The apparatus may be configured for use within a wellbore. For example, the apparatus may be configured for use within an open hole wellbore or a wellbore tubular such as a wellbore casing, liner, production tubing and/or the like.

The apparatus may be configured for use within a pipeline.

The extendable structure of a segment may be configured to extend laterally outwardly. For example, the segments may be configured to define a larger outer dimension in an extended configuration than in a retracted configuration.

In other embodiments, the extendable structure of a segment may be configured to extend laterally inwardly. For example, the segments may be configured to define a smaller inner dimension in an extended configuration than in a retracted configuration.

Each segment may be generally annular in form.

Each segment may be generally cylindrical in form.

The segments may be configured for mounting on a base structure. The base structure may, for example, comprise at least one of a tubular, a fluid conduit, a base pipe, production tubing, casing/liner tubing, a mandrel and the like. The segments may be configured for mounting on an outer or an inner surface of the base structure.

The apparatus may be configured for use within an annulus defined within a tubular such as a fluid conduit. For example, the apparatus may be configured for use within an annulus defined by a base structure and a tubular which surrounds the base structure.

The apparatus may comprise the base structure.

The apparatus may be configured to form a seal, an anchor, a supporting structure and/or a flow restriction in a fluid conduit. For example, the apparatus may be configured to form a seal, an anchor, a supporting structure and/or a flow restriction within an annulus defined by a base structure when the apparatus is located within a fluid conduit.

The apparatus may be configured such that the extendable structure of a segment is urged to extend laterally on axial compression of the segment.

The apparatus may be configurable between an extended configuration in which the extendable structure of at least one of the plurality of segments is laterally extended, and a retracted configuration in which all of the extendable structures of the plurality of segments are laterally retracted. The apparatus may be deployed within and/or retrieved from a fluid conduit when the apparatus is in the retracted configuration.

The apparatus may be configured into an extended configuration at least by an axial actuation force applied at or through opposing axial ends of each segment.

The apparatus may be configured into an extended configuration by axial collapse of each segment. The apparatus may be configured into an extended configuration by applying an axial actuation force through each segment to drive the opposing ends of each segment closer together to cause lateral displacement or deformation of the extendable structure of each segment.

The apparatus may be configured into an extended configuration by a lateral actuation force such as a radial actuation force.

At least one segment may comprise or define a bellows structure. Such a bellows structure may permit lateral extension of at least one segment to be achieved on axial compression of the segment.

The extendable structure of each segment may be biased to extend in a desired lateral direction.

The extendable structure of each segment may be biased to extend in a radial direction relative to the longitudinal axis.

The extendable structure of each segment may be biased by the structural arrangement of the segment. For example, the extendable structure of each segment may be arranged such that an actuation force can only cause extension in a particular lateral direction. Alternatively, or additionally, an actuation force may be applied such that extension of the extendable structure is achieved in a desired lateral direction.

At least one of the segments may be configured to engage a surface of a proximate object such as a fluid conduit or a base structure. For example, at least one of the segments may be configured to comply with, seal against and/or grip a proximate object.

At least one of the segments may comprise one or more features for engaging and/or gripping a proximate object. For example, at least one of the segments may comprise one or more gripping elements, projections, teeth, serrations, dogs and/or the like. At least one of the segments may comprise one or more diamond and/or carbide elements attached to an outer surface of, or at least partially embedded within, the segment.

At least one segment may comprise a seal for sealing against a proximate object such as a fluid conduit or a base structure.

The seal may comprise a seal feature which is formed integrally with the segment.

The seal may comprise a seal element which is formed separately from the segment and later attached to the segment.

The seal may be deformable.

The seal may be flexible.

The seal may be structurally weaker than the segment with which the seal is associated.

The seal may protrude from the at least one segment in the lateral direction.

The seal may comprise at least one of a rib, lip, vane, ridge, pip and the like.

The seal may comprise an elastomeric material.

The seal may comprise a metal.

The seal may extend laterally outwardly from an outer surface of at least one of the segments. The seal may extend laterally outwardly from an outermost portion of at least one of the segments.

The seal may extend laterally inwardly from an inner surface of at least one of the segments. The seal may extend laterally inwardly from an outermost portion of at least one of the segments.

The seal may be generally annular.

The seal may extend circumferentially with respect to the longitudinal axis of the apparatus.

The seal may extend helically with respect to the longitudinal axis of the apparatus.

In use, the seal may engage a surface of a proximate object such as a fluid conduit and/or a base structure which may be of poor quality. For example, the surface of a proximate object and/or a base structure may be rusty, pitted, out-of-round, grooved, scaled or waxed. This is particularly true for surface conditions of oilfield bores and tubulars. If the absence of such a seal, a segment having a perfectly round outer profile would not be able to comply completely with any irregularities of a proximate object and would not be able to form a positive sealing boundary. The seal may, however, comply with any irregularities of a proximate object whilst the corresponding segment itself need not be deformed to form a sealing boundary. The seal may serve to entrap, entrain and/or retain any support or filler material disposed around the seal adjacent to or in engagement with the segment with which the seal is associated. This may provide an enhanced sealing capability with a proximate object when the seal engages the proximate object.

The seal may be configured to be further energised by pressure. For example, the seal may have a geometry which provides enhanced sealing when the seal engages a proximate object.

At least one segment may comprise a plurality of seals such as one or more seal features and/or one or more seal elements.

At least two segments may define a common dimension when in a retracted configuration. For example, at least two segments may define a common outer and/or inner dimension when in a retracted configuration. In some embodiments, all segments may define a common dimension when in a retracted configuration. Such an arrangement may permit the apparatus to define a substantially uniform dimension when in a retracted configuration which may assist in, for example, deployment of the apparatus, such as in or through a wellbore.

The apparatus may be configured for use within an environment in which at least one of the segments is laterally restrained by a proximate object when at least one of the segments is in a laterally extended configuration. In this arrangement, one or more restrained segments may not be permitted to extend laterally so as to achieve a maximum lateral dimension. For example, one or more segments may be configured to be restrained before achieving a maximum lateral dimension. This may permit the restrained segment or segments to perform a desired function, such as a sealing function, anchoring function or the like.

The apparatus may be configured to be used within an environment in which the extendable structures of the segments are all laterally unrestrained when in a laterally extended configuration. In this arrangement, each segment may be permitted to be extended laterally to its maximum extended dimension. Such an arrangement may provide a support structure capable of withstanding axial loads. Such an apparatus may be capable of extending laterally into a complementary feature such as a groove, recess or the like formed in a proximate object so as to prevent relative axial movement between the apparatus and the proximate object. Such an apparatus may provide a variable and/or a selectively operable flow restriction.

The sequential initiation of the lateral extension of the extendable structures of at least two segments may permit the lateral extension of the extendable structures of at least two segments of the apparatus to occur in a repeatable, predictable order on application of an actuation force. This may permit the lateral extension of the extendable structures of at least two segments to be performed more reliably.

The sequential initiation of the lateral extension of the extendable structures of at least two non-adjacent segments may permit transmission of an actuation force to the extendable structures of one or more intervening segments during lateral extension of the at least two non-adjacent segments. This is because, if the extendable structures of the at least two non-adjacent segments were to extend and engage a proximate object at or around the same time, the extendable structures of the at least two non-adjacent segments may become anchored relative to the proximate object and may prevent the application of the actuation force to the extendable structures of the intervening segment(s) thus preventing axial collapse and lateral extension of the intervening segment(s). Accordingly, such an apparatus may ensure that the intervening segment(s) may be reliably extended until they engage a proximate object and/or they reach their respective maximum lateral extended dimensions regardless of whether the at least two non-adjacent segments engage the proximate object. The extension of the segments of such an apparatus may be performed with greater reliability and/or greater repeatability. This may be particularly advantageous when the apparatus is deployed and subsequently extended in an inaccessible or restricted space such as a space within a fluid conduit. Such an apparatus may, in particular, be used as, or constitute at least a part of a packer, bridge plug, anchor or the like for use within a fluid conduit.

The apparatus may be configured such that lateral extension of the extendable structure of one segment is completed before lateral extension of the extendable structure of a different segment begins.

The apparatus may be configured such that lateral extension of the extendable structure of one segment begins before lateral extension of the extendable structure of a different segment ends.

Where lateral extension of the extendable structure of a first segment ends before lateral extension of the extendable structure of a second segment ends, the extendable structure of the first segment may provide support to the extendable structure of the second segment. Such an arrangement may provide stabilisation of the apparatus during the extension process.

Different segments may be structurally arranged to ensure the sequential initiation of lateral extension of the extendable structures of the segments. For example, different segments may be structurally arranged to react differently during actuation of the extendable apparatus. The structural arrangement of one segment may permit initiation of lateral extension of the extendable structure of that segment before initiation of lateral extension of the extendable structure of a different segment.

Different segments may define different geometries. For example, different segments may define different geometries so as to provide the extendable structure of each segment with a different mechanical advantage. A segment having an extendable structure with a higher mechanical advantage in this respect may extend before a segment having an extendable structure with a lower mechanical advantage.

The extendable structures of different segments may define different angles relative to the longitudinal axis of the apparatus when the segments are in a retracted configuration. This may ensure or at least contribute towards the sequential initiation of lateral extension of the extendable structures of different segments.

The extendable structures of different segments may have different lengths. This may ensure or at least contribute towards the sequential initiation of lateral extension of the extendable structures of different segments.

Different segments may have extendable structures of different wall thicknesses. This may ensure or at least contribute towards the sequential initiation of lateral extension of the extendable structures of different segments.

Different segments may have extendable structures of different wall thickness profiles. Different segments may have extendable structures which define curved surfaces of varying or different curvature. One or more segments may have extendable structures defining outwardly convex surfaces. One or more segments may have extendable structures defining outwardly concave surfaces. This may ensure or at least contribute towards the sequential initiation of lateral extension of the extendable structures of different segments.

The apparatus may be configured such that a fully or partially laterally extended segment provides support to an adjacent segment.

At least two adjacent segments may be configured to include adjacent support surfaces which provide mutual support for one another when the at least two adjacent segments are laterally extended.

Establishing support between the adjacent support surfaces of the segments may permit the segments to support each other when in a laterally extended configuration. The provision or creation of such support may permit higher extension ratios to be achieved without compromising integrity. Further, higher extension ratios may be achievable without requiring the use of additional supporting arrangements. Furthermore, providing at least two adjacent segments having different maximum extended dimensions may permit only a larger segment to define a desired extended dimension of the apparatus. In this way a robust and supported extended structure may be created to provide the necessary degree of extension of the apparatus without requiring all segments to extend to the same maximum dimension. This may, for example, reduce the required material usage and expense, permit use of a smaller apparatus to provide a desired extension, permit an increased expansion ratio to be achievable and the like. In some embodiments, a larger segment may be utilised to perform a desired function, and a smaller segment may only be provided to function to support. In this way the supporting function of the smaller segment may not be compromised by the requirement to provide some additional function.

At least two adjacent segments may be configured to include adjacent support surfaces which are mutually engaged when the at least two adjacent segments are laterally extended.

During extension, the adjacent support surfaces may be pressed together.

During retraction, the adjacent support surfaces may become separated.

When in an extended configuration, adjacent mutually supporting segments may collectively exhibit improved mechanical strength relative to a retracted/non-extended configuration. When in an extended configuration, adjacent mutually supporting segments may exhibit improved mechanical strength relative to the retracted configuration in one or both radial and axial directions.

When in an extended configuration the apparatus may define a support structure, such as an annular support structure. The support structure may be configured to provide support in one or both lateral and axial directions. The apparatus may be configured to establish support to resist deformation from an applied force when the apparatus is in use. The applied force may comprise a reaction force, such as may be generated when the apparatus applies or is used to apply a force on an external component. The applied force may comprise a fluid pressure force, for example a dynamic fluid pressure force, a static fluid pressure force or the like.

The apparatus may be configured to provide self support when in an extended configuration. For example, the apparatus may be configured to perform a desired function, wherein said function is achieved and/or supported by the apparatus itself when in an extended configuration. For example, when in an extended configuration the apparatus may function as a seal, an anchor, a fluid restriction, and/or the like.

This ability of the apparatus to provide self support may permit the use of weaker, for example thinner, segment wall thicknesses thus reducing the actuation force required to configure the apparatus in the extended configuration and reducing stresses induced within the apparatus during extension. This ability of the apparatus to provide self support may, in particular, remove any requirement for each segment to be structurally competent in its own right. Thus, such an apparatus may provide significant advantages over known packers, bridge plugs, straddles, anchors and the like even at low or zero expansion ratios.

The apparatus may be configured to provide support to one or more separate components. For example, the apparatus may be configured to support a sealing component, such as a packer component, to support one or more slip components or the like. The apparatus may be configured to actuate, such as by moving, a separate component during extension of the apparatus, and optionally maintain the separate component in an actuated state while providing support thereto.

The extendable structures of different segments may be configured so as to define different maximum dimensions when fully laterally extended. This may permit the apparatus to extend laterally until at least one segment becomes laterally restrained. This may ensure that at least one segment engages a restraining object when the exact dimensions and/or the position of the restraining object relative to the apparatus is unknown. This may, in particular, ensure that at least one segment engages a proximate object having an unknown inner and/or an unknown outer diameter. Furthermore, this arrangement may permit a single sized apparatus to be used in multiple different applications requiring different extension dimensions. This may therefore permit a reduced inventory, for example, to be held for use in multiple different environments/applications. In this arrangement, smaller and unrestrained segments may provide support to the restrained segment or segments. Such an arrangement may provide progressive support and stability for extended segments having greater maximum extended dimensions during the extension process. Such an arrangement may provide progressive support and stability for highly extended segments during the extension process.

The segments may define increasing, or decreasing, maximum laterally extended dimensions. Such an arrangement may permit the segments to define a generally tapered structure when in a laterally extended configuration.

The apparatus may comprise opposing axial extremity regions, wherein the segments are arranged between said extremity regions. In this arrangement the maximum extended dimensions of the segments may vary from one extremity region to the other extremity region. For example, the maximum extended dimensions of adjacent segments may, generally, increase from one extremity region to the other extremity region. The maximum extended dimensions of adjacent segments may, generally, increase and then decrease from one extremity region to the other extremity region. The maximum extended dimensions of adjacent segments may, generally, decrease then increase from one extremity region to the other extremity region.

In some embodiments, at least two segments may define substantially similar maximum extended dimensions. Such embodiments may be used in applications where the degree of extension required is lesser, where each segment is stable in its own right and does not need support during lateral extension and/or when the proximate object size is known (or the variation in size of the proximate object is minimal). In use, the adjacent segments of such embodiments may extend in sequence to engage the proximate object and provide mutual support to one another, whilst engaging the proximate object at multiple contact points such as multiple sealing or multiple anchor points. Such embodiments may be used for sealing in well-defined fluid conduits for which the extension required is minimal or effectively zero. In such fluid conduits, such embodiments may permit a sequential energising sequence of the segments whilst still providing mutual support between the segments. Such embodiments may also permit a sequential energising sequence of the segments whilst still providing mutual support between the segments in fluid conduits for which larger extensions are required.

The apparatus may be configured such that, when a segment is laterally extended, the extendable structure of the segment defines an optimum profile relative to the longitudinal axis of the apparatus so as to maximise the lateral force that may be withstood by the segment.

The extendable structures of different segments may be configured to ensure that the extendable structures of the different segments adopt different profiles when extended. This may ensure that the extendable structure of at least one segment adopts a profile close to an optimum profile required to maximise the lateral force that may be withstood by a segment when the extendable structures of the different segments engage a proximate object. For example, the extendable structures of different segments may be configured so as to define different profiles when in the retracted configuration and/or so as to define different profiles when fully extended.

The apparatus may be configured for sequential initiation of lateral extension of the different segments using a constant actuation force. Structural differences between different segments may, for example, provide different mechanical advantages for the extendable structures of the different segments. For example, one segment may be configured such that a portion of the extendable structure thereof may experience a greater turning moment for a given axial actuation force relative to a portion of the extendable structure of a different segment.

The apparatus may be configured for sequential initiation of lateral extension of the extendable structures of different segments using different actuation forces for each segment. For example, the apparatus may be configured such that one force is required for initiation of lateral extension of the extendable structure of one segment, and a different force, typically a greater force is required for initiation of lateral extension of the extendable structure of a different segment.

The apparatus may be configured to selectively permit one or more segments to extend laterally. For example, each segment may comprise a retaining arrangement which is selectively configurable between a retaining state in which the segment is retained in a retracted configuration and a non-retaining state in which the segment is permitted to extend laterally.

The respective retaining arrangements may be sequentially reconfigured from the retaining state to the non-retaining state. For example, the respective retaining arrangements may be reconfigured one after another on the basis of elapsed time. The respective retaining arrangements may be reconfigured on the application of a force. For example, the respective retaining arrangements may be reconfigured to permit extension of one segment after another on the basis of increasing force.

Each retaining arrangement may comprise a shearing arrangement. For example, each retaining arrangement may comprise a shear element such as a shear pin, screw or the like. Each shear element may be configured to retain a corresponding segment in a retracted state and to be sheared to permit extension of the corresponding segment when an actuation force reaches a corresponding shear force.

Each retaining arrangement may be re-configurable from the non-retaining state to the retaining state.

The apparatus may be configured for actuation by an actuation force applied mechanically at or through the axial ends of each segment.

The apparatus may comprise an actuator such as a hydraulic, pneumatic or electrical actuator for operation, extension and/or retraction of the extendable apparatus.

The apparatus may be configured for hydraulic and/or pneumatic actuation by pressurised and/or compressed fluid for the lateral extension of the extendable structures of each segment.

The apparatus may be configured for actuation by a single actuator, such as a single tool or the like. The apparatus may be configured for actuation by transmitting actuation force through each segment from one segment to another.

At least two segments may be configured for actuation by different actuators. For example, one actuator may operate or actuate one segment, and a different actuator may operate a different segment. Sequential operation of the different actuators may provide for sequential extension of different segments.

The apparatus may be configured such that the extendable structure of a segment is urged to extend laterally on the application of a lateral force and/or a lateral pressure to the extendable structure.

The apparatus may be configured such that the extendable structure of a segment is urged to extend laterally in response to the application of an axial compression force and one or both of a lateral force and a lateral pressure to the extendable structure.

Each segment may be configured for lateral extension as a result of inflation by a pressurised and/or compressed fluid. Use of a pressurised and/or compressed fluid may promote the lateral extension of a segment. Use of a pressurised and/or compressed fluid may serve to avoid or at least reduce the extent of any unpredictable folding such as crumpling or wrinkling of a segment during lateral extension of the segment. Each segment may be configured to be pressurised before actuation by axial compression. Such an arrangement may improve the distribution of stress in a segment and serve to eliminate or at least mitigate any crumpling of the segment during subsequent lateral extension thereof.

The apparatus may be configured such that a pressurised and/or compressed fluid acts laterally outwardly and/or laterally inwardly on each segment.

At least one segment may comprise a unitary component. At least one segment may be formed from multiple components. An end of one segment may be located adjacent to an end of an adjacent segment.

The ends of adjacent segments may be separated. For example, the ends of adjacent segments may be separated by a separate structure, such as a non-extendable structure.

The ends of adjacent segments may be configured for the transfer of force therebetween, such as an actuation force.

The ends of adjacent segments may be linked or connected.

The end of one segment may define or form part of the end of an adjacent segment.

Adjacent segments may share a common end.

Adjacent segments may be integrally formed.

The ends of a segment may be laterally non-extendable.

The ends of the segment may be laterally extendable.

The extendable structure of at least one segment may be configured to extend to a greater degree than the associated ends of the segment.

The extendable structure of at least one segment may be configured to extend to the same degree as the associated ends of the segment.

A segment may be laterally symmetric when in a retracted configuration. That is, a segment may be symmetric about a lateral axis when in a retracted configuration. Such symmetry may permit a generally laterally symmetric extended configuration to be achieved.

A segment may be laterally asymmetric when in a retracted configuration. That is, a segment does not define any symmetry about any lateral axis. Such asymmetry may permit a laterally asymmetric extended configuration to be achieved. Such an arrangement may permit the segment to adopt a desired shape or profile before, during and/or after extension, for example to bias a segment profile in a particular direction. For example, the segment may be directed towards, lean in, or be skewed or tapered towards a particular axial direction.

The extendable structure of a segment may define or comprise a unitary component.

The extendable structure of a segment may be defined by or comprise multiple components. For example, the extendable structure of a segment may include multiple axially spaced components and/or multiple circumferentially spaced components.

The extendable structure of a segment may comprise first and second portions.

The first and second portions may be integrally formed.

The first and second portions may be separately formed.

The first portion may be located to one side of a lateral plane and a second portion may be located to an opposite side of the lateral plane.

The first and second portions may axially overlap.

The first and second portions may be linked or connected. The first and second portions may be connected so as to permit relative movement between the first and second portions. For example, adjacent ends of the first and second portions may be connected so as to permit relative movement between the first and second portions. Adjacent ends of the first and second portions may be pivotally connected or hinged.

The first and second portions may be configured to laterally extend the extendable structure as the first and second portions are moved axially towards one another.

The first and second portions may be configured to extend the extendable structure in a laterally outward direction relative to an axis of the extendable apparatus as the first and second portions are moved axially towards one another.

The first and second portions may be configured to extend the extendable structure in a laterally inward direction relative to an axis of the extendable apparatus as the first and second portions are moved axially towards one another.

The first and second portions may be substantially identically configured. In other embodiments the first and second portions may be configured differently.

The first and second portions may be conical or part conical.

The first and second portions may be frustro-conical and arranged axially in back-to-back relation.

The first and second portions may be curved in an axial direction.

The first and second portions may define different geometries.

The first portion may be conical, part conical or frustro-concical and the second portion may be curved in an axial direction.

The first portion may extend axially over a greater distance that the second portion.

The first portion may define a greater wall thickness than the second portion.

One or both of the first and second portions may define an engagement surface for engaging a corresponding engagement surface of an adjacent segment when the segments are extended.

The extendable structure may comprise an intermediate portion disposed between the first and second portions. The intermediate portion may be configured to define a maximum extended dimension of said segment.

The intermediate portion may be integrally formed with one or both of the first and second portions.

The intermediate portion may be separately formed relative to at least one of the first and second portions and subsequently secured thereto.

The intermediate portion may be defined by one or both of the first and second portions.

The first and second portions may be reconfigurable to laterally extend the intermediate portion. The first and second portions may be reconfigurable by axial compression or movement thereof to laterally extend the intermediate portion. The first and second portions may be displaceable to laterally extend the intermediate portion. For example the first and second portions may be displaceable between different positions. The first and second portions may be deformable to laterally extend the intermediate portion.

The apparatus may comprise deformable support or filler material disposed around or adjacent to the extendable structure of at least one segment.

The support material may be softer and/or weaker than a material from which the segments are formed.

The support material may be substantially incompressible. The support material may include at least one of a low yield material, a composite, a polymer such as an elastomer, a plastics material, a polytetrafluoroethylene (PTFE), a metal such as a ductile metal, and the like.

The support material may comprise a gel or a liquid.

The support or filler material may provide for the transfer of force between an extendable structure of the segment around or adjacent to which the support material is disposed and the extendable structure of an adjacent segment. The support material may be disposed between the extendable structures of adjacent segments. The support material may be attached to the extendable structures of one or more segments.

The support material may be encapsulated, trapped, sealed or otherwise locally contained around or adjacent to, the extendable structures of a segment so as to prevent exposure of the support material to a pressurised fluid. This may serve to avoid any subsequent decompression effects that may damage the support material.

The support material may assist to reduce stress in a segment around which it is disposed during lateral extension of the segment.

The support material may serve to avoid or at least reduce localised concentrations of strain in a segment around which it is disposed during lateral extension of the segment. The use of such support material may serve to provide a more even distribution of strain across a segment around or adjacent to which the support material is disposed and thereby avoid pivots, plastic hinges and/or lines of weakness.

The support material may be disposed around or adjacent to at least one segment so as to prevent direct engagement with an adjacent segment whilst still permitting the transfer of axial forces therebetween. This arrangement may permit adjacent segments to support one another.

The apparatus may comprise at least one support material structural element attached to the extendable structures of at least one segment and embedded within or surrounded by the support material. For example, the apparatus may comprise a metal element, wire mesh or the like attached to the extendable structures of at least two adjacent segments and embedded within or surrounded by the support material. Where lateral extension of at least one of the adjacent segments results in inelastic deformation of the support material, such support material structural elements may serve to assist the support material to return towards a retracted configuration of the support material which existed prior to lateral extension of the segment.

At least one segment may define a continuous structure. One or both of the first and second portions may define a continuous structure. In some embodiments one or both of the first and second portions may comprise a generally cylindrical structure. One or both of the first and second portions may comprise a conical or frustro-conical structure.

At least one segment may define a discontinuous structure. For example, one or both first and second supporting portions of a segment may define a discontinuous structure. At least one segment may have one or more discontinuities, such as slots, slits or the like formed therein. The provision of a discontinuous structure may permit the associated segment to be more readily extended, for example by requiring a lower activation or extension force. In embodiments of the invention in which adjacent segments define discontinuities, said segments may be arranged to offset said discontinuities, at least when in an extended configuration. This may permit the segments to be more readily extended without compromising, or without significantly compromising the mechanical strength of the extended structure. However, in some embodiments such discontinuities may be aligned with each other.

At least one segment may comprise multiple elements to define a discontinuous structure. For example, one or both first and second supporting portions of an extendable structure of a segment may comprise multiple elements, such as rods, bars, panels, plates or the like. Such multiple elements may be arranged to define a cage structure, for example. Such multiple elements may be pivotally connected to one another. The apparatus may comprise one or more movable collar portions between the axial extremities thereof. Adjacent segments may be pivotally connected to the movable collar portions.

One or more segments may be at least partially covered, for example by a coating, sheath, sleeve or the like. Such a coating may comprise a metallic material, non-metallic material, elastomer, polymer or the like.

At least one segment may be configured to engage a surface of a proximate object to establish a seal against said proximate object. In this way the apparatus may be configured as a sealing apparatus.

The apparatus may be configured for use with a seal structure. The apparatus may comprise a seal structure. The segments may be configured to support the seal structure when the apparatus is in an extended configuration. The apparatus may be configured to actuate the seal structure during or as a result of being reconfigured to an extended configuration. For example, extension of one or more segments, for example by axial compression thereof, may cause the seal structure to be reconfigured into a sealing configuration. The apparatus may be configured to axially compress a seal structure. The seal structure may comprise a substantially solid sealing body, such as an elastomeric sealing body, swellable sealing body or the like. The seal structure may comprise an inflatable seal structure.

The apparatus may be configured for use in sealing against an outer object. The apparatus may be configured for use in sealing against an inner object. The apparatus may be configured for use in establishing zonal isolation within a wellbore. The apparatus may be configured for use in providing Blow Out Prevention measures associated with a wellbore. For example, the apparatus may be configured for use in emergency procedures, and may be provided to be extended in the event of an urgent sealing requirement.

At least one segment may be configured to engage a surface of a proximate object to establish an anchor against said object. For example, the apparatus may be secured to or form part of a suspended structure, wherein the apparatus is extended to engage at least one segment with a proximate object to permit the suspended structure to be secured or anchored relative to the proximate object.

The apparatus may be configured for use with an anchor structure. The apparatus may comprise an anchor structure. The segments may be configured to support the anchor structure when the apparatus is in an extended configuration. The apparatus may be configured to actuate the anchor structure during or as a result of being reconfigured to an extended configuration. For example, extension of one or more segments, for example by axial compression thereof, may cause the anchor structure to be reconfigured into an anchoring configuration. The apparatus may be configured to laterally extend an anchor structure. The anchor structure may comprise one or more slips, dogs, keys, gripping elements, serrated blocks or the like.

The apparatus may be provided in at least two portions which each comprise a plurality of axially arranged laterally extendable segments, and at least two segments of each portion are configured to define different maximum extended dimensions and include adjacent engagement surfaces which are mutually engaged when the at least two segments are extended.

The at least two portions of the apparatus may be provided with an axial gap therebetween. The axial gap may be void. The axial gap may contain an object which is axially constrained by the at least two portions. The object may, for example, comprise a sealing object such as a seal body. The seal body may be deformable. The seal body may comprise an elastomeric material or a metal. The seal body may be inflatable.

At least one segment may comprise a metallic material. At least one segment may comprise a polymeric material. At least one segment may comprise an elastomeric material.

The apparatus may be reusable.

According to a second aspect of the present invention there is provided a method of extending an apparatus comprising sequentially initiating extension of extendable structures of at least two segments of the apparatus in a lateral direction relative to a longitudinal axis along which the apparatus is arranged.

One of more features associated with the first aspect may be provided in combination with the second aspect.

According to a third aspect of the present invention there is provided an apparatus comprising a plurality of extendable segments arranged along a longitudinal axis, wherein at least two segments are configured to define different maximum extended dimensions in a direction lateral to the longitudinal axis and include adjacent support surfaces which provide mutual support for one another when the at least two segments are laterally extended.

Establishing support between the adjacent support surfaces of the segments may permit the segments to support each other when in a laterally extended configuration. The provision or creation of such support may permit higher extension ratios to be achieved without compromising integrity. Further, higher extension ratios may be achievable without requiring the use of additional supporting arrangements. Furthermore, providing at least two adjacent segments having different maximum extended dimensions may permit only a larger segment to define a desired extended dimension of the apparatus. In this way a robust and supported extended structure may be created to provide the necessary degree of extension of the apparatus without requiring all segments to extend to the same maximum dimension. This may, for example, reduce the required material usage and expense, permit use of a smaller apparatus to provide a desired extension, permit an increased expansion ratio to be achievable and the like. In some embodiments, a larger segment may be utilised to perform a desired function, and a smaller segment may only be provided to function to support. In this way the supporting function of the smaller segment may not be compromised by the requirement to provide some additional function.

At least two adjacent segments may be configured to include adjacent support surfaces which are mutually engaged when the at least two adjacent segments are laterally extended.

During extension, the adjacent support surfaces may be pressed together.

During retraction, the adjacent support surfaces may become separated.

The segments may be configured to be laterally extended on axial compression.

When in a laterally extended configuration, adjacent mutually supporting segments may collectively exhibit improved mechanical strength relative to a retracted/non-extended configuration. When in an extended configuration, adjacent mutually supporting segments may exhibit improved mechanical strength relative to the retracted configuration in one or both lateral and axial directions.

When in an extended configuration the apparatus may define a support structure, such as an annular support structure. The support structure may be configured to provide support in one or both lateral and axial directions. The apparatus may be configured to establish support to resist deformation from an applied force when the apparatus is in use. The applied force may comprise a reaction force, such as may be generated when the apparatus applies or is used to apply a force on an external component. The applied force may comprise a fluid pressure force, for example a dynamic fluid pressure force, a static fluid pressure force or the like.

The apparatus may be configured to provide self support when in an extended configuration. For example, the apparatus may be configured to perform a desired function, wherein said function is achieved and/or supported by the apparatus itself when in an extended configuration. For example, when in an extended configuration the apparatus may function as a seal, an anchor, a fluid restriction, or the like.

The apparatus may be configured to provide support to one or more separate components. For example, the apparatus may be configured to support a sealing component, such as a packer component, to support one or more slip components or the like. The apparatus may be configured to actuate, such as by moving, a separate component during extension of the apparatus, and optionally maintain the separate component in an actuated state while providing support thereto.

At least two segments may be configured to define different maximum extended dimensions in a lateral direction relative to the longitudinal axis and include adjacent engagement surfaces which are mutually engaged when the at least two segments are laterally extended.

One or more features associated with the first or second aspects may be provided in combination with the third aspect.

According to a fourth aspect of the present invention there is provided a method of extending an apparatus comprising laterally extending at least two segments of the apparatus so as to define a different maximum extended dimension for each of the at least two segments in a direction lateral to a longitudinal axis along which the apparatus is arranged and so that adjacent support surfaces of the at least two segments provide mutual support for one another.

One or more features associated with one or more of the first to third aspects may be provided in combination with the fourth aspect.

According to a fifth aspect of the present invention there is provided an apparatus for use in providing a support structure within a fluid conduit, the apparatus comprising a plurality of segments arranged along a longitudinal axis, wherein the segments are extendable in a lateral direction relative to the longitudinal axis and at least two segments are configured to define different maximum laterally extended dimensions and include adjacent support surfaces which provide mutual support for one another when the at least two segments are laterally extended to establish a support structure within a fluid conduit.

One or more features associated with one or more of the first to fourth aspects may be provided in combination with the fifth aspect.

According to a sixth aspect of the present invention there is provided a method for use in providing a support structure within a fluid conduit, comprising:

providing an apparatus comprising a plurality of segments arranged along a longitudinal axis, each of the segments being extendable in a direction lateral to the longitudinal axis;

locating the apparatus within a fluid conduit; and laterally extending at least two segments so as to define different maximum laterally extended dimensions for the at least two segments within the fluid conduit and so that adjacent support surfaces of the at least two segments provide mutual support for one another.

One or more features associated with one or more of the first to fifth aspects may be provided in combination with the sixth aspect.

According to a seventh aspect of the present invention there is provided an apparatus for use in providing a seal within a fluid conduit, the apparatus comprising a plurality of segments arranged along a longitudinal axis and configured to be laterally extended relative to the longitudinal axis to establish a seal, wherein at least two segments are configured to define different maximum laterally extended dimensions and include adjacent support surfaces which provide mutual support for one another when the at least two segments are laterally extended.

At least one segment may be configured to engage a surface of a proximate object to establish a seal against said proximate object.

The apparatus may comprise a seal structure. The segments may be configured to support the seal structure when the apparatus is in an extended configuration. The apparatus may be configured to actuate the seal structure during or as a result of being reconfigured to an extended configuration. For example, extension of one or more segments, for example by axial compression thereof, may cause the seal structure to be reconfigured into a sealing configuration. The apparatus may be configured to axially compress a seal structure. The seal structure may comprise a substantially solid sealing body, such as an elastomeric sealing body, swellable sealing body or the like. The seal structure may comprise an inflatable seal structure.

One or more features associated with one or more of the first to sixth aspects may be provided in combination with the seventh aspect.

According to an eighth aspect of the present invention there is provided a method for use in providing a seal within a fluid conduit, comprising:

providing an apparatus comprising a plurality of segments arranged along a longitudinal axis, each of the segments being extendable in a direction lateral to the longitudinal axis;

locating the apparatus within a fluid conduit; and laterally extending at least two segments so as to define different maximum laterally extended dimensions for the at least two segments within the fluid conduit and so that adjacent support surfaces of the at least two segments provide mutual support for one another.

One or more features associated with one or more of the first to seventh aspects may be provided in combination with the eighth aspect.

According to a ninth aspect of the present invention there is provided an apparatus for use in providing an anchor within a fluid conduit, the apparatus comprising a plurality of segments arranged along a longitudinal axis and configured to be laterally extended relative to the longitudinal axis to establish an anchor within a fluid conduit, wherein at least two segments are configured to define different maximum laterally extended dimensions and include adjacent support surfaces which provide mutual support for one another when the at least two segments are extended.

At least one segment may be configured to engage a surface of a proximate object to establish an anchor point against said object. For example, the apparatus may be secured to or form part of a suspended structure, therein the apparatus is extended to engage at least one segment with a proximate object to permit the suspended structure to be secured or anchored relative to the proximate object.

The apparatus may comprise an anchor structure. The segments may be configured to support the anchor structure when the apparatus is in an extended configuration. The apparatus may be configured to actuate the anchor structure during or as a result of being reconfigured to an extended configuration. For example, extension of one or more segments, for example by axial compression thereof, may cause the anchor structure to be reconfigured into an anchoring configuration. The apparatus may be configured to radially extend an anchor structure. The anchor structure may comprise one or more slips, dogs, keys, serrated blocks or the like.

One or more features associated with one or more of the first to eighth aspects may be provided in combination with the ninth aspect.

According to a tenth aspect of the present invention there is provided a method for use in providing an anchor structure within a fluid conduit, comprising:

providing an apparatus comprising a plurality of segments arranged along a longitudinal axis, each of the segments being extendable in a direction lateral to the longitudinal axis;

locating the apparatus within a fluid conduit; and laterally extending at least two segments so as to define different maximum extended dimensions and so that adjacent support surfaces of the at least two segments provide mutual support for one another.

One or more features associated with one or more of the first to ninth aspects may be provided in combination with the tenth aspect.

BRIEF DESCRIPTION OF THE DRAWINGS

These and other aspects of the present invention will now be described, by way of non-limiting example only, with reference to the accompanying drawings, in which:

FIG. 1(*b*) is a longitudinal cross-sectional view of the apparatus of FIG. 1(*a*) taken through line A-A;

FIG. 3(*b*) is a longitudinal cross-sectional view of the apparatus of FIG. 3(*a*) taken through line A-A;

FIG. 5(*e*) is an illustration of the apparatus of FIG. 5(*a*) shown in use in an extended configuration within an annular space between two tubular members;

FIGS. 6(*a*)-(*d*) are illustrations of a longitudinal cross-sectional of an extendable apparatus constituting an embodiment of the present invention demonstrating the sequential lateral extension of different segments of the apparatus;

FIG. 6(*e*) is a detailed view of a segment of the extendable apparatus of FIG. 6(*a*);

FIG. 9(*b*) is an illustration of the apparatus of FIG. 9(*a*) shown in use in an extended configuration within an annular space between two tubular members;

FIG. 10(*b*) is a front elevation of the apparatus of FIG. 10(*a*);

FIG. 10(*c*) is a longitudinal cross-sectional taken through line A-A of the apparatus of FIG. 10(*b*);

FIG. 10(*d*) is an end elevation of the apparatus of FIG. 10(*b*);

FIG. 11(*b*) is a front elevation of the apparatus of FIG. 11(*a*);

FIG. 11(*c*) is a longitudinal cross-sectional taken through line A-A of the apparatus of FIG. 11(*b*);

FIG. 11(*d*) is an end elevation of the apparatus of FIG. 11(*b*);

FIG. 12(*b*) is a longitudinal cross-sectional view of the apparatus of FIG. 12(*a*) taken through line A-A;

FIG. 13(*b*) is a longitudinal cross-sectional view of the apparatus of FIG. 13(*a*) taken through line A-A;

FIG. 14(*b*) is a longitudinal cross-section of the apparatus of FIG. 14(*a*), shown in use in an extended configuration within an annular space between two tubular members;

FIG. 16(*b*) is a cross-sectional view of the apparatus shown in FIG. 16(*a*), taken through line A-A;

FIG. 19(*b*) is a longitudinal cross-sectional view of the apparatus of FIG. 19(*a*) taken through line A-A;

DETAILED DESCRIPTION OF THE DRAWINGS

Figure 1A:
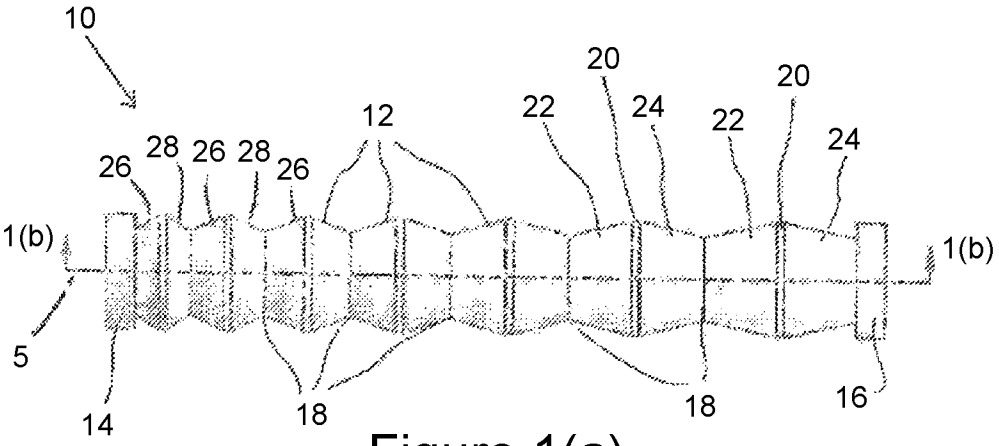
FIG. 1(*a*) is an illustration of an extendable apparatus constituting an embodiment of the present invention, shown in a retracted configuration.
Figure 1B:
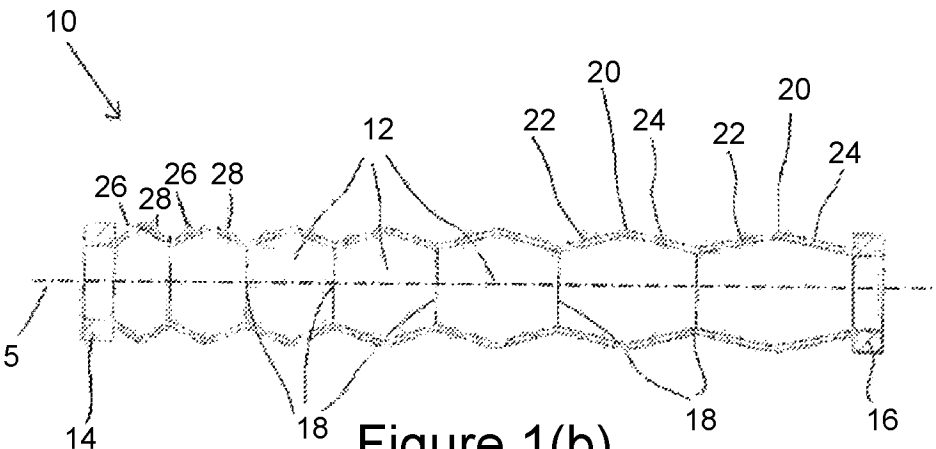

FIG. 1(*a*) illustrates an extendable apparatus, generally identified by reference numeral 10, constituting an embodiment of the present invention, wherein the apparatus 10 is shown in a retracted configuration extending along a longitudinal axis 5. A corresponding longitudinal cross-sectional view of the apparatus 10 is also shown in FIG. 1(*b*). As will be described in further detail below, the apparatus 10 may be utilised within a wellbore environment, and may be used to provide downhole functions such as sealing functions, anchoring functions, support functions, fluid control functions and the like.

The apparatus 10 comprises a plurality of axially arranged segments or bulbs 12 which collectively define a bellows structure extending between left and right extremities provided by collar portions 14, 16. In the embodiment shown, each segment 12 extends between a pair of axially opposing ends or seam regions 18. The segments 12 are integrally formed with each other and joined at the seam regions 18. However, in other embodiments the segments may be separately formed and subsequently secured together. Although not shown in FIGS. 1(*a*) and 1(*b*), the apparatus 10 may be mounted on a tubular member, such as a production tubing string.

Each segment 12 is composed of a laterally extendable structure comprising an intermediate annular portion 20 disposed between first and second generally conical portions 22, 24. Each segment 12 is generally symmetrical about a lateral plane which extends through the intermediate annular portion 20. The portions 22, 24 define outwardly facing support surfaces 26, 28. For the embodiment shown in FIGS. 1(*a*) and 1(*b*), the support surface 26 of a portion 22 of one segment 12 is configured to engage the support surface 28 of a portion 24 of an adjacent segment 12 when the apparatus 10 is reconfigured to a laterally extended configuration as described in more detail below.

Each segment 12 defines a different axial length, and in the embodiment shown each segment sequentially increases in length from the left collar 14 towards the right collar 16. Also in the embodiment shown, the annular portion 20 of each segment 12 defines a common retracted diameter.

Figures 2A, 2B, 2C, 2D, 2E, 2F, 2G, 2H:
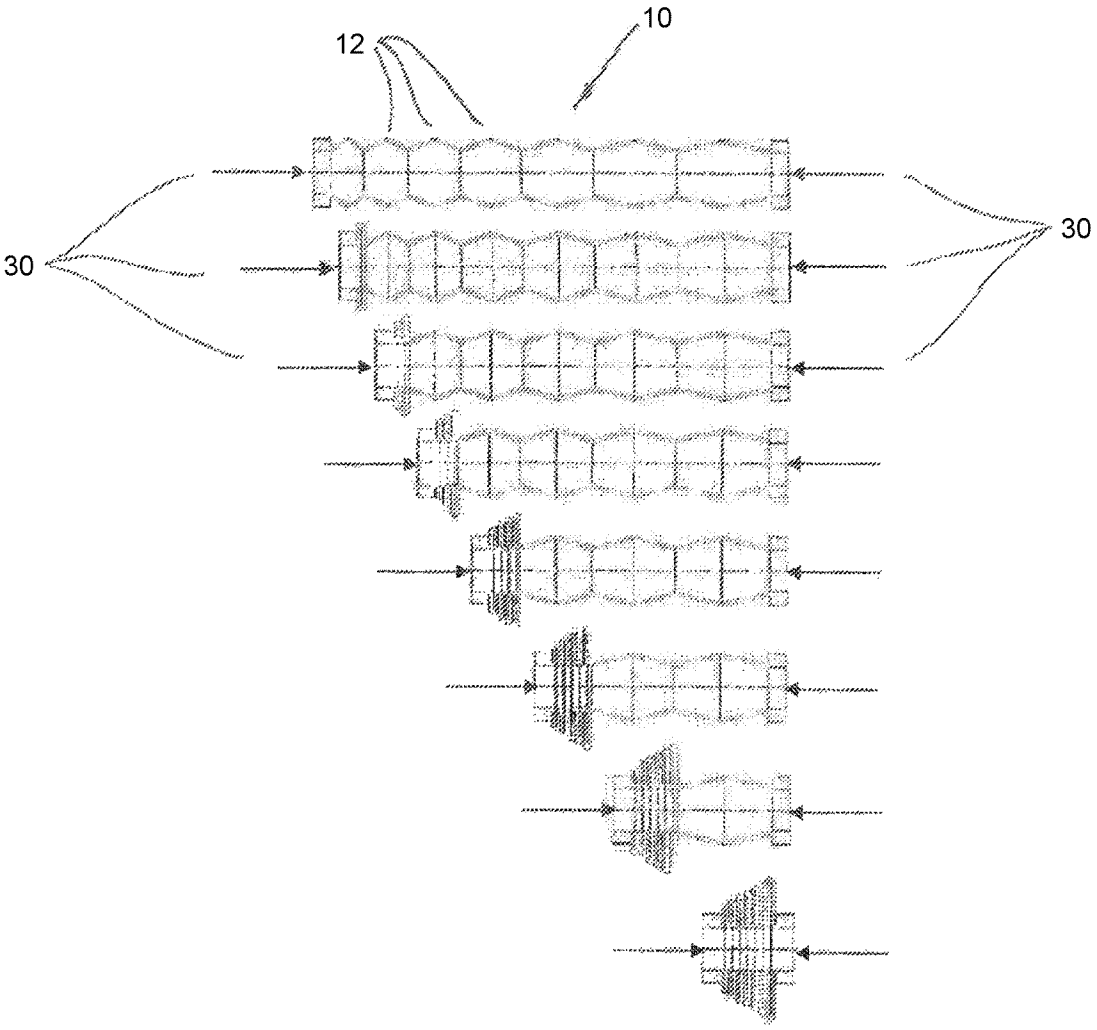
FIGS. 2(*a*)-(*h*) are illustrations of the apparatus of FIG. 1(*a*) demonstrating the sequential lateral extension of different segments of the apparatus.

Reference is now made to FIGS. 2(*a*)-(*h*) which illustrate the sequential axial compression and corresponding sequential lateral extension of apparatus 10 which arises as a result of the aforementioned geometrical differences between the segments 12. As illustrated by arrows 30, the apparatus 10 is reconfigured to an extended configuration by axial compression of the segments 12. Such axial compression may be provided by a setting tool (not shown). Upon compression by a sufficient force the segments 12 are caused to deform sequentially, particularly at the adjoining seam regions 18 and at the annular portions 20, to effectively extend the annular portions 20 one-by-one laterally with respect to longitudinal axis 5. The geometrical differences ensure that the portions 22 and 24 of the left-most segment 12 adjacent to the left collar 14 experience a greater turning moment on application of an axial compression force to the apparatus 10 causing the left-most segment 12 to collapse axially and the annular portion 20 of the left-most segment 12 to extend laterally before the annular portions 20 of the other segments 12. Sequential laterally extension of the annular portions 20 may permit one or more of the annular portions 20 to engage an inner surface of an outer tubular restraining member (not shown) one-by-one.

The sequential lateral extension of the annular portions 20 may ensure that the extendable structure 22, 24 of one segment 12 provides support to the extendable structure 22, 24 of an adjacent segment 12 while the extendable structure 22, 24 of the adjacent segment 12 is being laterally extended. Such an arrangement may provide stabilisation of the extendable apparatus 10 during the extension process. Furthermore, if the annular portions 20 of two or more different segments 12 were to engage an inner diameter of an outer tubular restraining object at or around the same time, the annular portions 20 may anchor the extendable apparatus 10 relative to the restraining object and prevent the application of an actuation force to the annular portions 20 of any intervening segments 12, thus preventing axial collapse and lateral extension thereof. Thus, the sequential lateral extension of segments 12 may avoid blocking of the application of an actuation force to one or more segments 12 during lateral extension of the apparatus 10 which may otherwise occur if lateral extension of segments 12 were to occur simultaneously.

As illustrated in FIGS. 2(*a*)-(*h*), lateral extension of one segment 12 is completed before lateral extension of an adjacent segment 12 begins. However, one skilled in the art will appreciate that in other embodiments, the lateral extension of the adjacent segment 12 may begin before lateral extension of the segment 12 is complete.

Figure 3A:
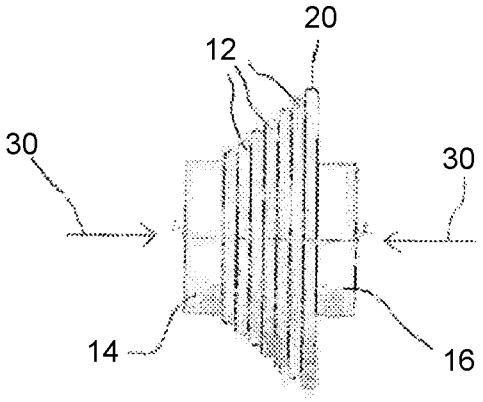
FIG. 3(*a*) is an illustration of the apparatus of FIG. 1(*a*), shown in an extended configuration.
Figure 3B:
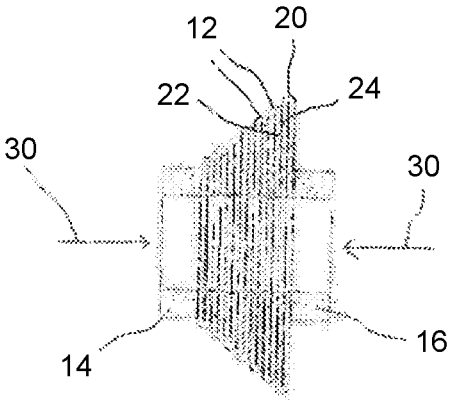

Reference is now made to FIGS. 3(*a*) and 3(*b*) which illustrate the apparatus 10 in an extended configuration. As illustrated, the annular portion 20 of each segment 12 defines a different maximum extended diameter, which in the embodiment shown is achieved by virtue of the different axial lengths of the segments when in the retracted configuration (FIGS. 1(*a*) and 1(*b*)). More particularly, the segments 12 are arranged to define increasing outer diameters between the left and right collars 14, 16 which provides a generally tapered structure. Thus, the extendable apparatus 10 may be used in the formation of a restriction, a seal or an anchor with respect to outer tubular restraining members of different inner diameters or with a tubular restraining member whose inner diameter is not accurately known. Furthermore, when in the extended configuration the support surfaces 26, 28 of adjacent segment portions 22, 24 are pressed together (best illustrated in FIG. 3*b*). Such an arrangement may permit the segments 12 to support each other when in an extended configuration, which may in turn permit increased extension ratios to be achieved without compromising integrity. More specifically, when in an extended configuration, the engaged adjacent segments 12 may collectively exhibit improved mechanical strength relative to a retracted/non-extended configuration.

Accordingly, when in the extended configuration the apparatus 10 may define a support structure which is capable of providing support in one or both lateral and axial directions. Such a support structure may be configured to establish support to resist deformation from an applied force, such as a mechanical force, fluid pressure force or the like. This ability to support may have multiple applications, some of which are described hereinafter.

It should be understood that the extendable apparatus may define any desired extended profile. For example, the apparatus 100 shown in FIG. 4 includes a plurality of segments 112 arranged between left and right collars 114, 116, wherein the maximum extended diameters of the segments 112 increase from each collar 114, 116 towards a central portion of the apparatus 100. Such an embodiment may be utilised for sealing purposes, anchoring purposes, fluid control or the like.

Figure 4:
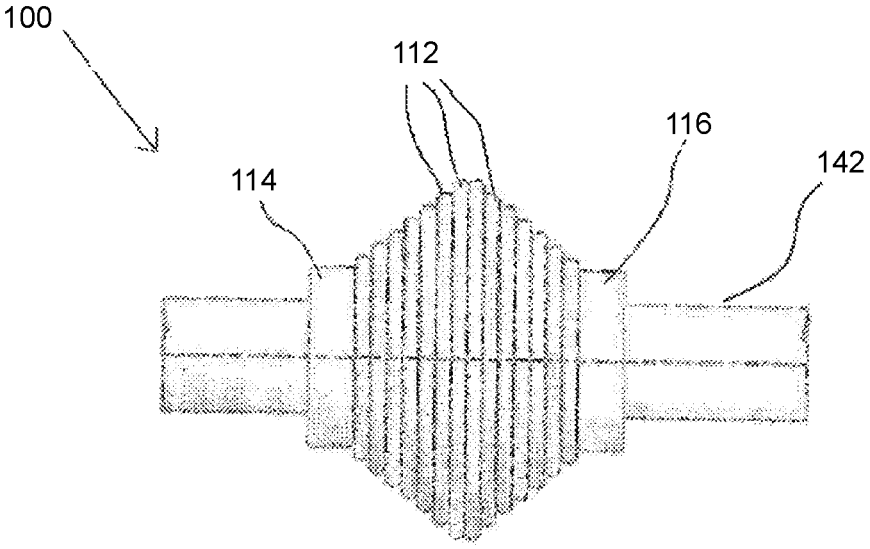
FIG. 4 is an illustration of an extendable apparatus constituting an embodiment of the present invention shown in use in an extended configuration around a tubular member.
Figure 5A:
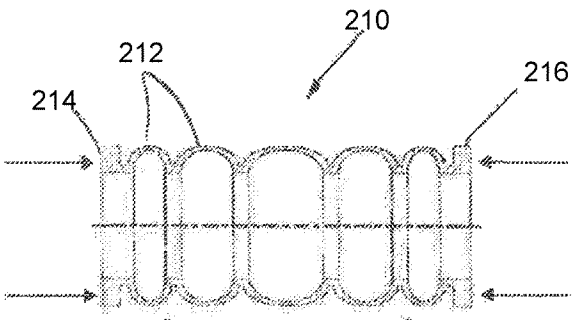
FIGS. 5(*a*)-(*d*) are illustrations of a longitudinal cross-sectional of an extendable apparatus constituting an embodiment of the present invention demonstrating the sequential lateral extension of different segments of the apparatus.
Figure 5B:
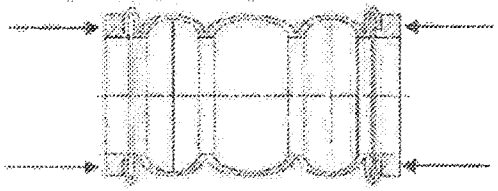
Figure 5C:
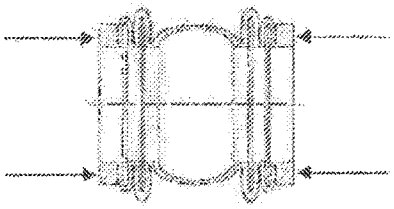
Figure 5D:
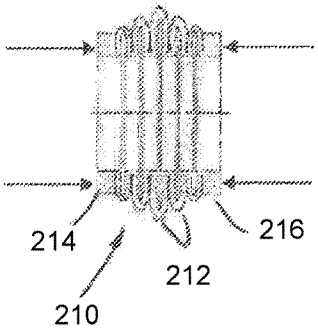
Figure 5E:
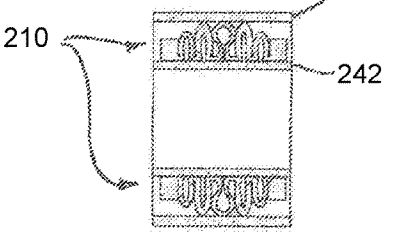

The radial extension sequence of an apparatus wherein the maximum extended diameters of the segments increase from each collar towards a central portion of the apparatus such as the apparatus 100 of FIG. 4 may differ from the lateral extension sequence illustrated in FIGS. 2(*a*)-(*h*) for the apparatus 10. For example, FIGS. 5(*a*)-(*d*) illustrate the lateral extension sequence for an apparatus 210 which includes a plurality of segments 212 arranged between left and right collars 214, 216, wherein the maximum extended diameters of the segments 212 increase from each collar 214, 216 towards a central portion of the apparatus 210. In contrast to the segments 112 of the apparatus 110 of FIG. 4, the segments 212 of the apparatus 210 are generally more curved. The curvature of the segments 212 decreases for each segment 212 from the collars 214, 216 towards a central portion of the apparatus 210. Since the axially outermost segments 212 adjacent to the collars 214, 216 have the greatest curvature, on application of an axial compression force to the apparatus 210, the axially outermost segments 212 collapse axially and laterally extend before the intervening segments 212 which are located axially towards the central portion of the apparatus 210. In FIG. 5(*e*), the apparatus 210 is also shown in a fully extended configuration in use within an annular space between inner and outer tubular members 242 and 244 respectively in which the centre-most segment 212 engages an inner surface of the outer tubular member 244.

FIGS. 6(*a*)-(*d*) illustrate the lateral extension sequence for an apparatus 310 which includes a plurality of curved segments 312 arranged between left and right collars 314, 316, wherein the maximum extended diameters of the segments 312 are the same. In contrast to the segments 212 of the apparatus 210 of FIGS. 5(*a*) and 5(*b*), the curvature of each segment 312 is the same, but the wall thickness of each segment 312 increases from the left collar 314 towards the right collar 316. Consequently, the segment 312 adjacent to the left collar 314 is the weakest and deforms before the other segments 312. Subsequently, the other segments 312 collapse axially and extend laterally one-by-one until a fully laterally extended configuration is reached.

FIG. 6(*e*) shows a detailed view of the segment 312 adjacent to the left collar 314. As shown in FIG. 6(*e*), each segment 312 may comprise circumferential sealing ribs 317 which protrude radially outwardly from the segment 312 and which are designed to be crushed radially or to comply radially when compressed against an inner surface of a proximate object such as a tubular restraining member (not shown) surrounding the apparatus 310 so as to form a seal with the tubular restraining member. Such sealing features 317 may be integrally formed with the segments 312 or may be separately formed from and later attached to the segments 312. Such sealing features may comprise a metal or an elastomeric material. Additionally or alternatively, each segment 312 may comprise gripping elements, serrations, teeth, dogs or the like (not shown) which protrude laterally outwardly from the segment 312 and which are configured to engage and anchor the segment 312 with respect to the tubular restraining member when urged against the tubular restraining member. It will be understood that any of the other embodiments described with reference to the other figures may also comprise similar sealing features or gripping elements.

Figures 7A, 7B, 7C, 7D:
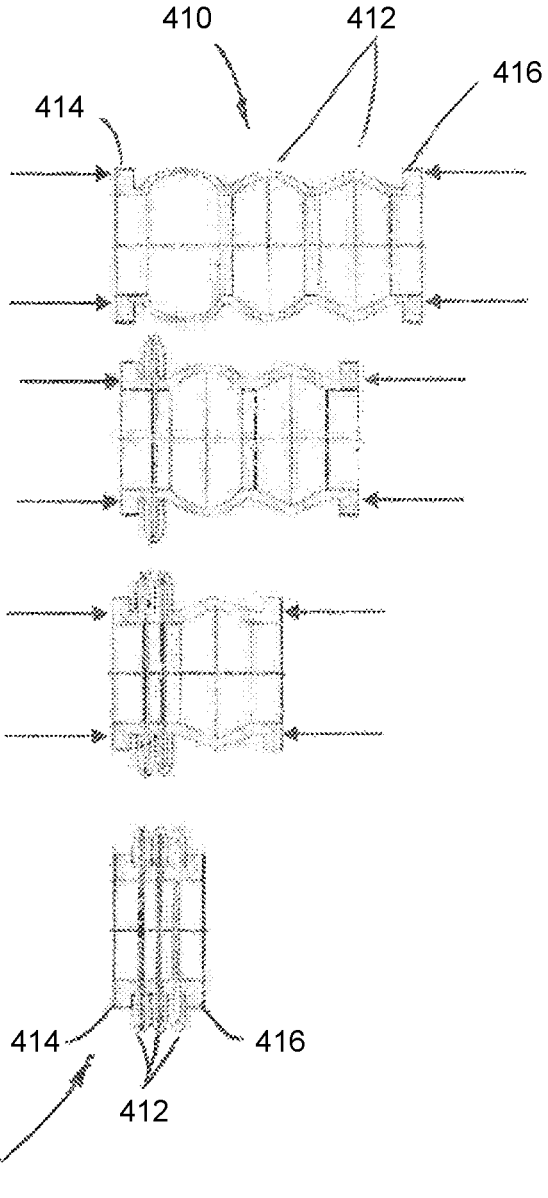
FIGS. 7(*a*)-(*d*) are illustrations of a longitudinal cross-sectional of an extendable apparatus constituting an embodiment of the present invention demonstrating the sequential lateral extension of different segments of the apparatus.
Figure 8A:
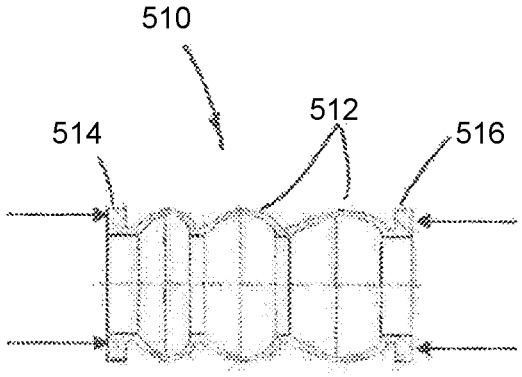
FIGS. 8(*a*)-(*d*) are illustrations of a longitudinal cross-sectional of an extendable apparatus constituting an embodiment of the present invention demonstrating the sequential lateral extension of different segments of the apparatus.
Figure 8B:
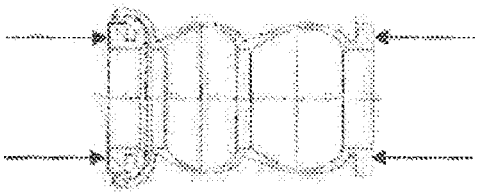
Figure 8C:
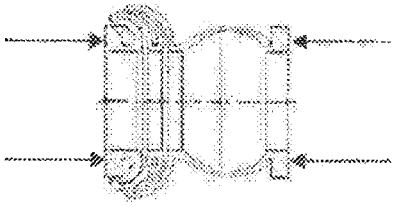
Figure 8D:
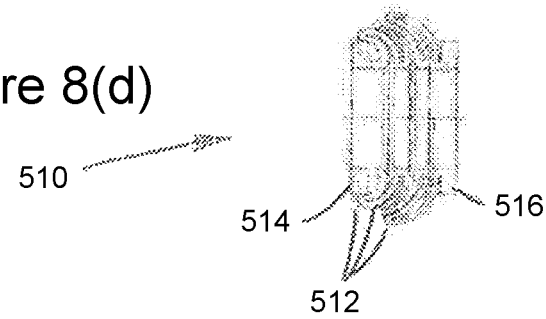

FIGS. 7(*a*)-(*d*) illustrate the lateral extension sequence for an apparatus 410 which includes a plurality of segments 412 arranged between left and right collars 414, 416, wherein the maximum extended diameters of the segments 412 are the same. In contrast to the segments 212 of the apparatus 210 of FIGS. 5(*a*) and 5(*b*) and the segments 312 of the apparatus 310 of FIGS. 6(*a*) and 6(*b*), the profile of each segment 412 changes progressively from the curved profile for the segment 412 adjacent the left collar 414 to the back-to-back frustro-conical shape of the segment 412 adjacent to the right collar 416 so as to ensure that the segments 412 collapse axially and extend laterally one-by-one from the left collar 414 to the right collar 416 until a fully laterally extended configuration is reached.

FIGS. 8(*a*)-(*d*) illustrate the lateral extension sequence for an apparatus 510 which includes a plurality of segments 512 arranged between left and right collars 514, 516, wherein the maximum extended diameters of the segments 512 increase and the curvature of the profile of each segment 512 decreases from the left collar 514 towards the right collar 516 so that the segments 512 collapse axially and extend laterally one-by-one from the left collar 514 to the right collar 516. In contrast to the segments 212 of the apparatus 210 of FIGS. 5(*a*) and 5(*b*), the profile of each segment 512 in the retracted configuration has no symmetry about any lateral plane. That is, the profile of each segment 512 in the retracted configuration is skewed or tapered to ensure that each segment 512 adopts an extended configuration in which the segment 512 is curved, directed or skewed at an angle to the lateral direction.

Figure 9A:
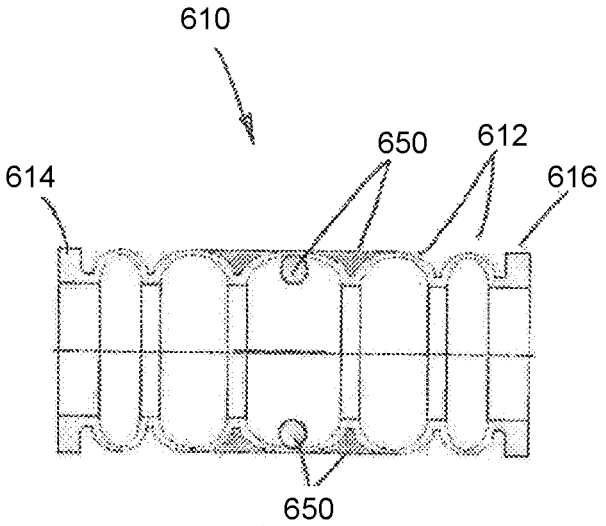
FIG. 9(*a*) is an illustration of a longitudinal cross-sectional of an extendable apparatus constituting an embodiment of the present invention demonstrating the sequential lateral extension of different segments of the apparatus.
Figure 9B:
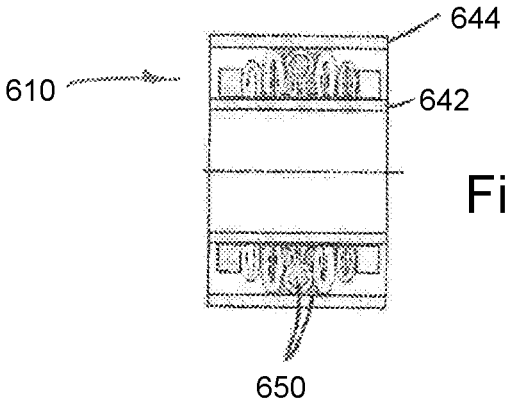
Figure 10D:
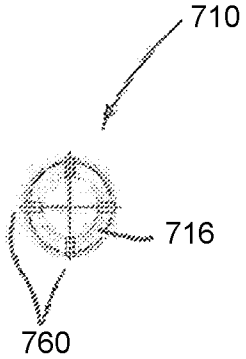
FIG. 10(*a*) is a perspective illustration of an extendable apparatus constituting an embodiment of the present invention, shown in a retracted configuration.
Figure 10A:
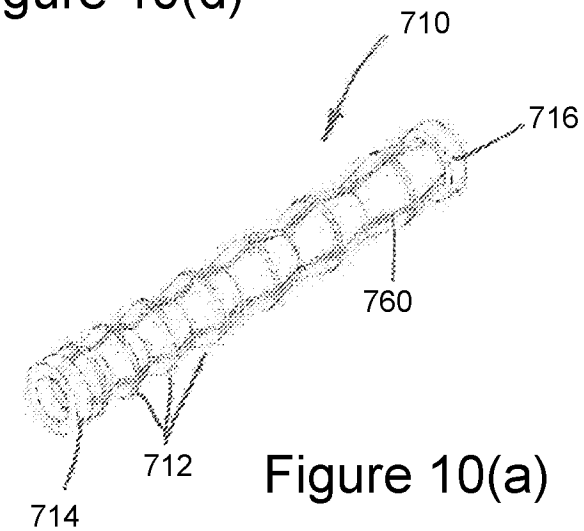
Figure 10B:
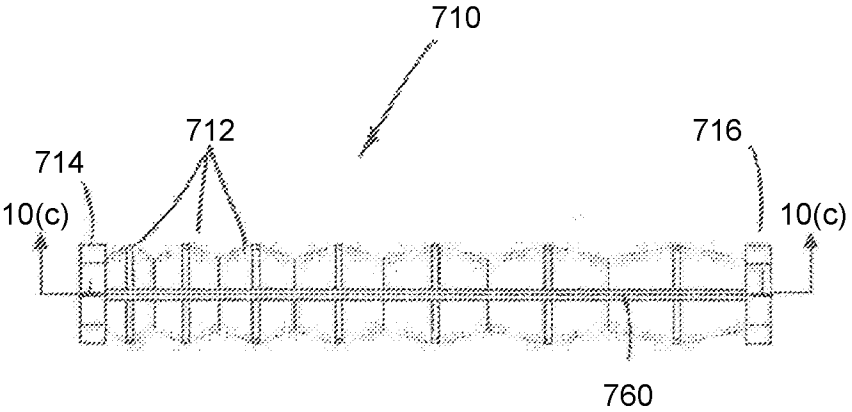
Figure 10C:
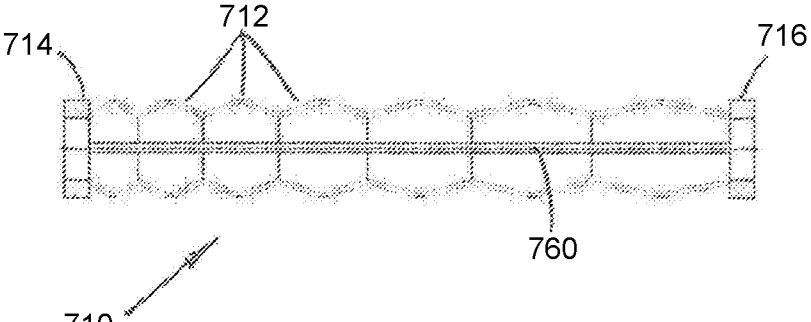
Figure 11B:
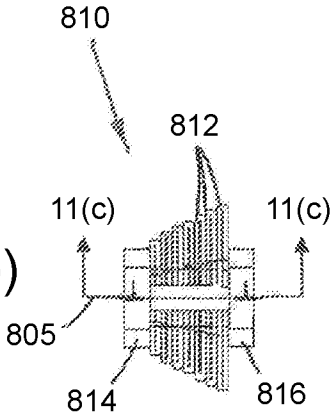
FIG. 11(*a*) is a perspective illustration of an extendable apparatus constituting an embodiment of the present invention, shown in an extended configuration.
Figure 11C:
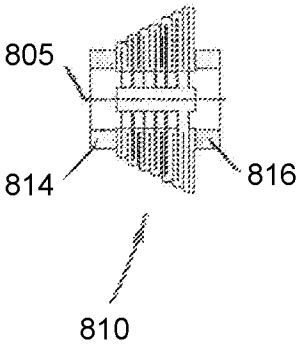
Figure 11D:
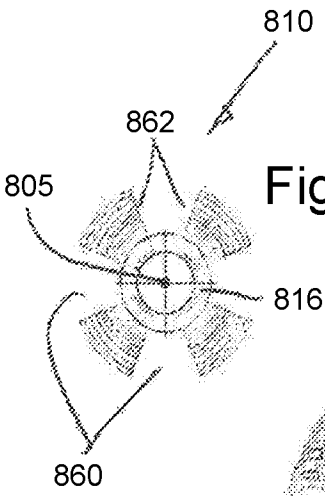
Figure 11A:
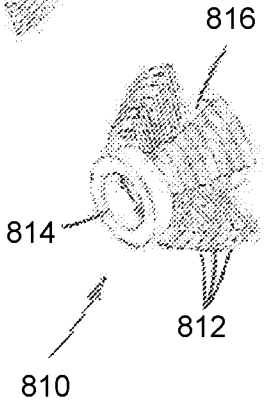

Another embodiment of an extension apparatus generally designated 610 is shown in FIGS. 9(*a*) and 9(*b*). Like the extension apparatus 210 of FIGS. 5(*a*) and 5(*b*), the extension apparatus 610 includes a plurality of segments 612 arranged between left and right collars 614, 616, wherein the maximum extended diameters of the segments 612 increase from each collar 614, 616 towards a central portion of the apparatus 610 and the curvature of the segments 612 decreases for each segment 612 from the collars 614, 616 towards a central portion of the apparatus 610. In contrast to the extension apparatus 210 of FIGS. 5(*a*) and 5(*b*), the extension apparatus 610 comprises deformable but generally incompressible support material 650 encapsulated so as to be disposed around some of the segments 612. In the embodiment shown in FIGS. 9(*a*) and 9(*b*), the support material 650 is located both radially outwardly and radially inwardly of the segments 612. The support material 650 is weaker and/or softer than a material from which the segments 612 are formed. The support material 650 reduces stress during deformation and lateral extension of the segments 612 around which it is disposed. FIG. 9(*b*) shows the extension apparatus 610 in a fully laterally extended configuration in an annular space between tubular members 642 and 644. When in the fully laterally extended configuration, the support material 650 prevents direct engagement between adjacent segments 612 whilst still permitting the transfer of axial forces therebetween to permit adjacent segments 612 to support one another. Examples of suitable support materials 650 include, low yield materials, composites, polymers such as elastomers, plastics, polytetrafluoroethylenes (PTFE's), metals such as ductile metals, gels, liquids and the like.

In each of the foregoing embodiments each segment is provided by a continuous structure. However, in other embodiments at least one segment may define a discontinuous structure. For example, FIGS. 10(*a*) to 10(*d*) illustrate an extendable apparatus 710 comprising a plurality of segments 712 extending between left and right collars 714 and 716 respectively. The segments 712 comprise or define one or more slots 760. This may permit the apparatus 710 to be reconfigured between retracted and extended configurations with a lower required force. In some embodiments (not shown), the slots 760 of adjacent segments may be circumferentially offset. FIGS. 11(*a*) to 11(*d*) illustrate a further extendable apparatus 810 shown in an extended configuration. The apparatus 810 comprises a plurality of segments 812 extending between left and right collars 814 and 816 respectively. The segments 812 comprise or define one or more slots 860. In contrast to the slots 760 of the apparatus 710, each slot 860 has sidewalls 862 that extend radially away from a longitudinal axis 805.

Figure 13A:
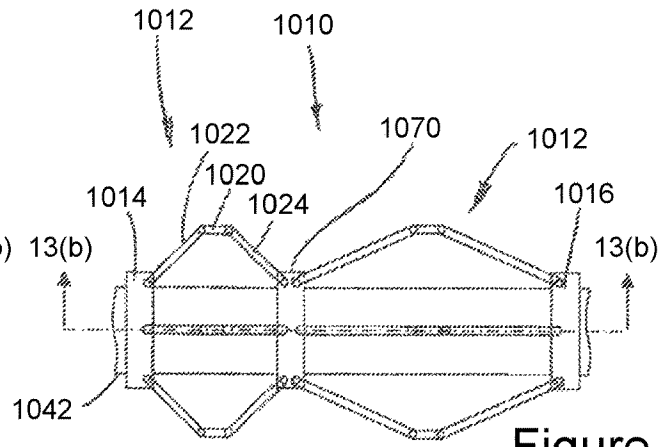
FIG. 13(*a*) is an illustration of an extendable apparatus constituting an embodiment of the present invention, shown in use in a retracted configuration around a tubular member.
Figure 13B:
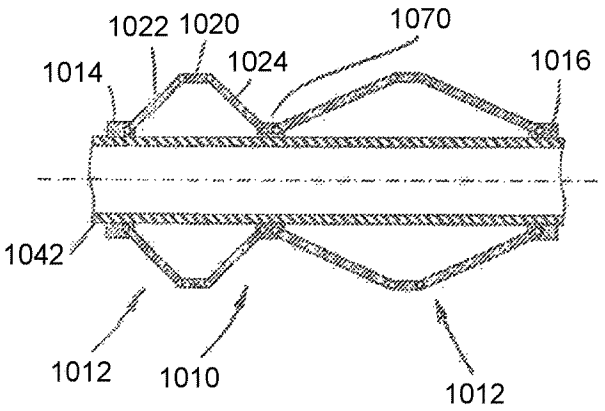
Figure 12A:
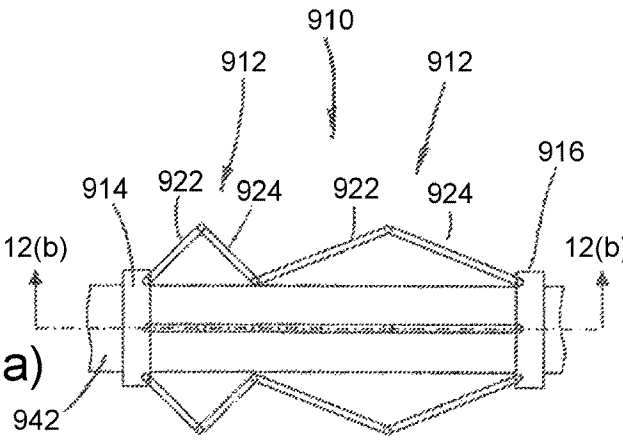
FIG. 12(*a*) is an illustration of an extendable apparatus constituting an embodiment of the present invention, shown in use in a retracted configuration around a tubular member.
Figure 12B:
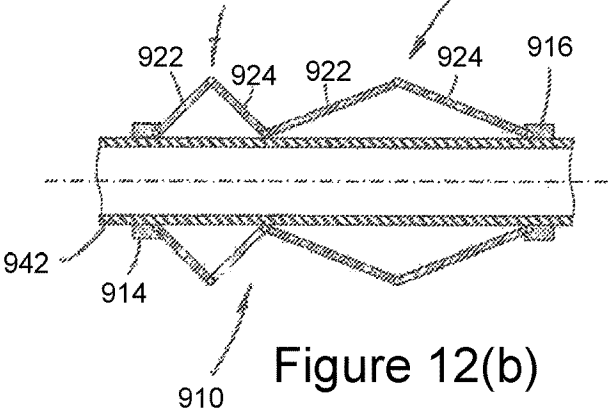

FIGS. 12(*a*) and 12(*b*) illustrate an extendable apparatus 910 shown in a retracted configuration in use around an inner tubular member 942. Like the foregoing embodiments, the apparatus 910 comprises a plurality of segments 912 extending between left and right collars 914 and 916 respectively. However, in contrast to the foregoing embodiments, the segments 912 of the apparatus 910 each comprise articulated rod-like members 922, 924. The member 922 of one segment 912 is pivotally connected to a member 924 of an adjacent segment 912. Similarly, FIGS. 13(*a*) and 13(*b*) illustrate an extendable apparatus 1010 shown in a retracted configuration in use around an inner tubular member 1042. The apparatus 1010 comprises a plurality of segments 1012 extending between left and right collars 1014 and 1016 respectively. Each segment 1012 comprises rod-like members 1022 and 1024 which support and are pivotally connected to a rod-like member 1020. The rod-like members 1020 are laterally extendable. Adjacent segments 1012 are connected by intermediate collars 1070. The member 1022 of one segment 1012 and the member 1024 of an adjacent segment 1012 are pivotally connected to an intermediate collar 1070 which is axially movable. On the application of an axial compression force to the apparatus 1010, the members 1022 and 1024 of the segments 1012 collapse axially so as to extend the members 1020 laterally segment-by-segment.

Figure 14A:
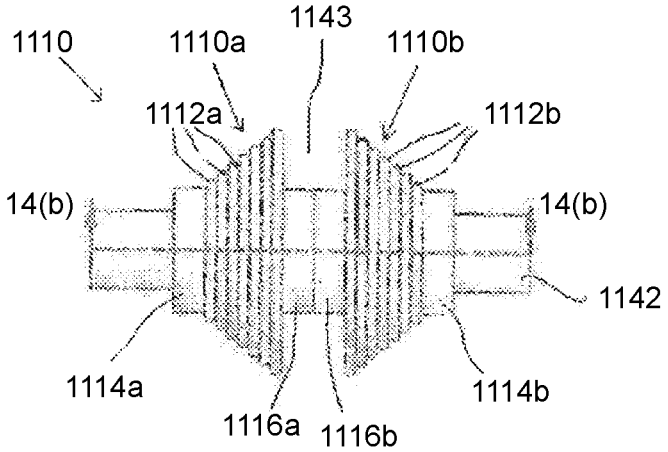
FIG. 14(*a*) is an illustration of an extendable apparatus in accordance with an alternative embodiment of the present invention, shown in use in an extended configuration around a tubular member.
Figure 14B:
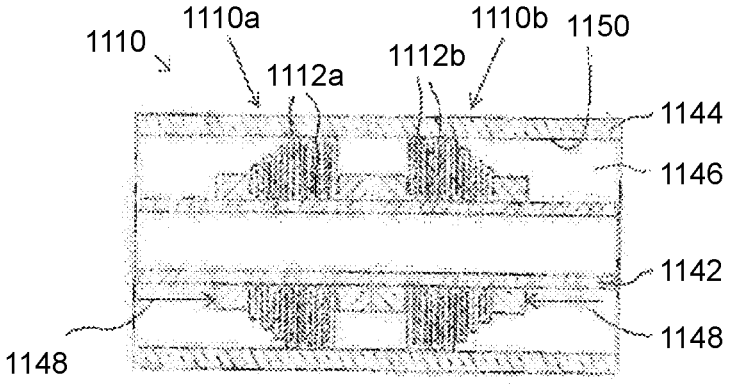

An extendable apparatus 1110 in accordance with an alternative embodiment of the present invention is shown in FIG. 14(*a*) and comprises a pair of axially arranged extendable portions 1110*a*, 1110*b* which are illustrated in extended configurations. Each portion 1110*a*, 1110*b* is configured in similar form to the apparatus 10 shown in FIGS. 1-3, and as such like components share like reference numerals. Specifically, features of the left portion 1110*a* are differentiated by the letter "a", and features of the right portion 1110*b* are differentiated by the letter "b". As such, each portion 1110*a*, 1110*b* includes a plurality of segments 1112*a*, 1112*b* which define increasing maximum extended diameters and which are mounted between respective collars 1114*a*, 1116*a*, 1114*b*, 1116*b*. Each portion 1110*a*, 1110*b* is mounted on a base pipe 1142, such as a production tubing string, in inverted or back-to-back relation such that when in an extended configuration as shown in FIG. 14(*a*) an annular gap 1143 is defined between the portions 1110*a*, 1110*b*. However, a reverse arrangement may be possible.

The apparatus 1110 may have multiple uses and applications. For example, as shown in FIG. 14(*b*) the apparatus 1110 may be used to establish a seal within a tubular member 1144, such as a casing or liner tubing string. The apparatus 1110 may be located within the tubular member 1144, thus defining an annulus 1146 between the base pipe 1142 and tubular member 1144, and the portions 1110*a*, 1110*b* then axially compressed in the direction of arrows 1148, for example by a setting tool (not shown), to cause the individual segments 1112*a*, 1112*b* to be laterally extended. As each segment 1112*a*, 1112*b* defines a sequentially increasing diameter, eventually one segment 1112*a*, 1112*b* will engage the inner surface 1150 of the tubular member 1144. Following this, the sequentially larger segments 1112*a*, 1112*b* will become restrained by the tubular member 1144, thus establishing intimate sealing against the inner surface 1150 to prevent the flow of fluid along the annulus 1146. This arrangement may permit the apparatus 1110 to be used in various tubulars having different diameters, which may thus minimise the required inventory, for example.

As adjacent segments 1112*a*, 1112*b* become engaged and pressed together when extended, the resulting sealing structures of the portions 1110*a*, 1110*b* exhibit significantly improved mechanical strength and can thus be applied in regions of high pressure differentials. Furthermore, the improved mechanical strength when in an extended configuration permits the apparatus 1110 to achieve high expansion ratios without compromising performance.

The operation of the apparatus 1110 in the manner shown in FIG. 14(*b*) may permit a seal to be achieved within the tubular member 1144. However, such operation may additionally, or alternatively, be used to establish an anchor within the tubular member. For example, the portions 1110*a*, 1110*b* may engage the tubular member 1144 to become anchored therein.

It should be understood that the apparatus 10 of FIGS. 1 and 2 may be used, in isolation, in such a sealing/anchoring operation demonstrated in FIG. 14(*b*).

Figure 15:
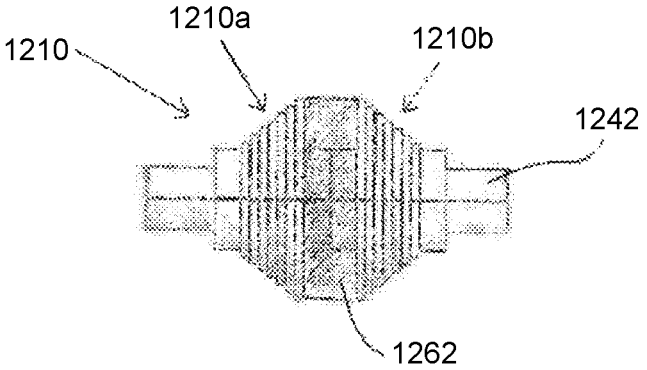
FIG. 15 is an illustration of an extendable apparatus for use in sealing constituting another embodiment of the present invention.

A further extendable apparatus 1210 according to another embodiment of the present invention is shown in FIG. 15. Apparatus 1210 is configured as a sealing apparatus and is similar to apparatus 1110 first shown in FIG. 14(*a*) in that it comprises a pair of laterally extendable portions 1210*a*, 1210*b* mounted on a base pipe 1242. However, apparatus 1210 further includes a seal body 1262 mounted between each laterally extendable portion 1210*a*, 1210*b*, wherein the seal body 1262 is formed of an elastomeric material, such as rubber or formed of a plastics material, formed of PTFE, or formed of a metal such as ductile metal. When the apparatus 1260 is arranged into the laterally extended configuration, as shown in FIG. 15, the seal body 1262 becomes axially compressed and is thus laterally extended, permitting the seal body 1262 to establish a seal with an outer tubular (for example, tubular member 1144 of FIG. 14(*b*)). Furthermore, each portion 1210*a*, 1210*b*, in addition to acting as actuators for the seal body 1262, also function to provide axial support to the seal body 1262 when in a laterally extended/sealing configuration. Providing such support may permit high expansion ratios to be achieved without compromising sealing performance. It should, however, be understood that such an embodiment may also provide advantages even for low or zero expansion ratios, such as providing an improved seal strength for a given wall thickness of the laterally extendable portions 1210*a*, 1210*b* or maintaining a given seal strength for a reduced wall thickness of the laterally extendable portions 1210*a*, 1210*b*.

Figure 16A:
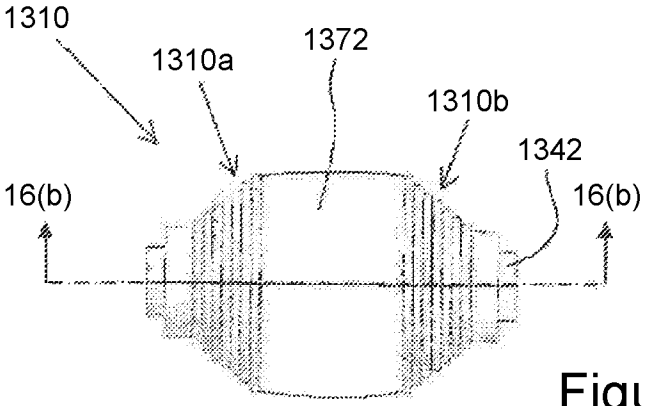
FIG. 16(*a*) is an illustration of an extendable apparatus for use in sealing, constituting another embodiment of the present invention.
Figure 16B:
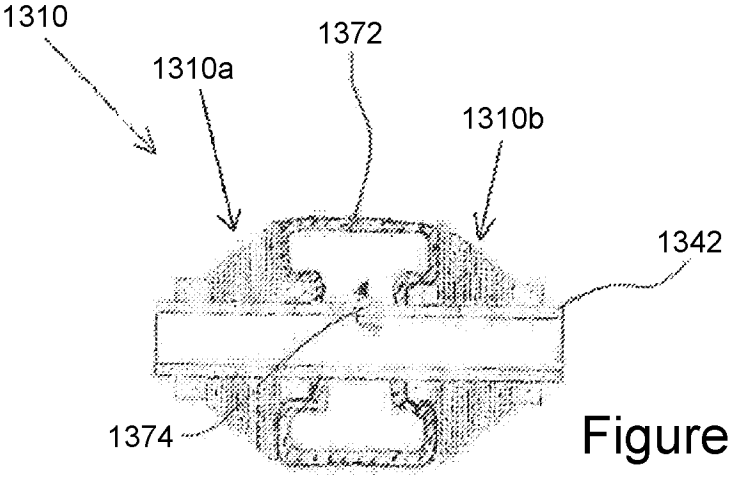

The seal body 1262 of the apparatus 1210 in FIG. 15 is provided as a solid body. However, in other embodiments the seal body may have other forms. For example, in an alternative apparatus 1310 shown in FIGS. 16(*a*) and 16(*b*) an inflatable seal body 1372 is interposed between a pair of laterally extendable portions 1310*a*, 1310*b* which are mounted on a base pipe 1342. The inflatable body 1372 is configured to receive an inflating medium, such as a fluid or gas, via one or more apertures 1374 formed in the base pipe 1342. In such an embodiment, each laterally extendable portion 1310*a*, 1310*b* may function to provide support (such as anti-extrusion support) to the inflatable seal body 1372. This may, in particular, permit high expansion ratios to be achieved without compromising sealing performance.

Figure 17:
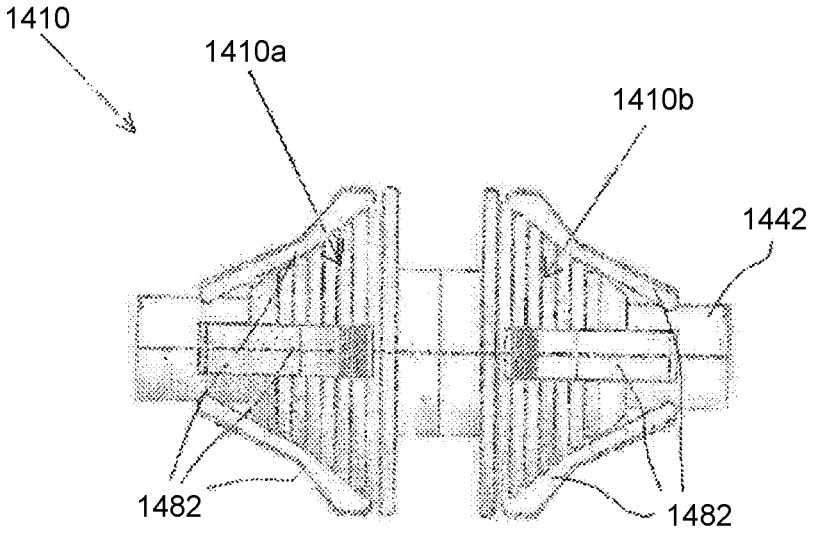
FIG. 17 is an illustration of an extendable apparatus for use in providing an anchor, constituting an embodiment of the present invention.

A further laterally extendable apparatus 1410 according to another embodiment of the present invention is shown in FIG. 17. Apparatus 1410 is configured as an anchoring apparatus and is similar to apparatus 1110 first shown in FIG. 14(*a*) in that it comprises a pair of laterally extendable portions 1410*a*, 1410*b* mounted on a base pipe 1442. However, apparatus 1410 further includes a plurality of slips 1482 which are arranged to be laterally extended by extension of each laterally extendable portion 1410*a*, 1410*b*. Such laterally extension of the slips 1482 may permit the apparatus to become anchored within an outer tubular (such as tubular 1144 in FIG. 14(*b*)).

Figure 18:
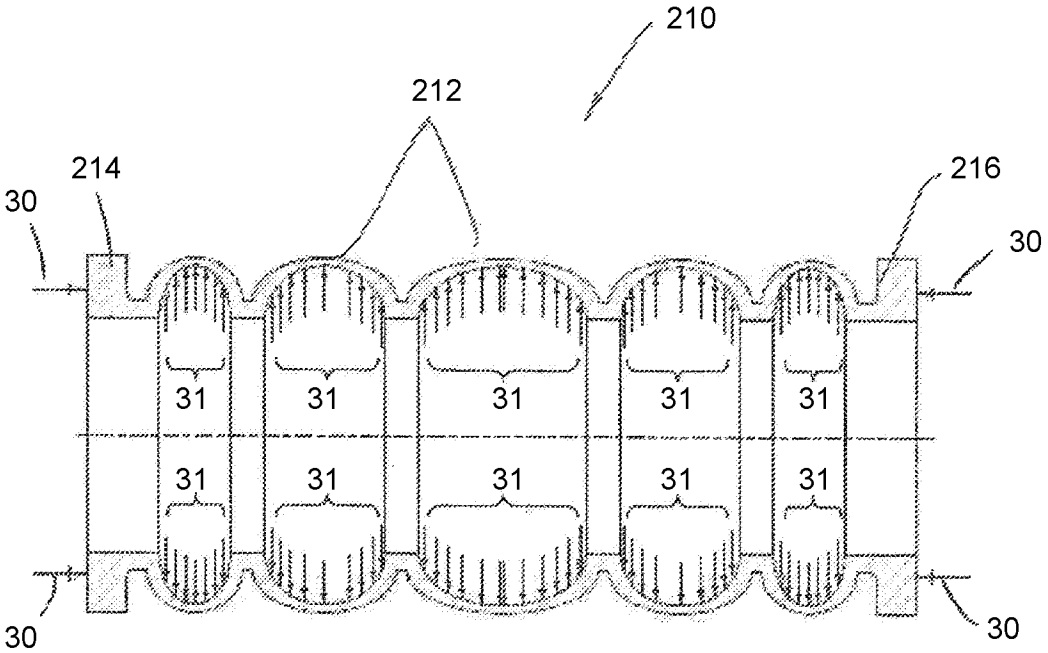
FIG. 18 is an illustration of an extendable apparatus constituting a further embodiment of the present invention, wherein the apparatus is configured for actuation by a combination of an axial force together with a lateral force and/or pressure.

FIG. 18 illustrates an alternative method of actuating the laterally extendable apparatus 210 first shown in FIGS. 5(*a*)-(*d*). Rather than applying only a compressive axial force to the apparatus 210, an outward lateral force 31, outward lateral forces 31 and/or outward lateral pressure 31 is applied to the apparatus 210 from within the apparatus 210 in addition to the axial compressive force 30 so as to laterally extend the apparatus 210. In a further alternative method of actuating the apparatus 210, the apparatus 210 is laterally extended under the action of an outward lateral force 31, outward lateral forces 31 and/or outward lateral pressure 31 without any axial compressive force 30. One skilled in the art will understand that such alternative methods of actuating the apparatus 210 may be used with the apparatus of any of the other foregoing embodiments.

Figure 19A:
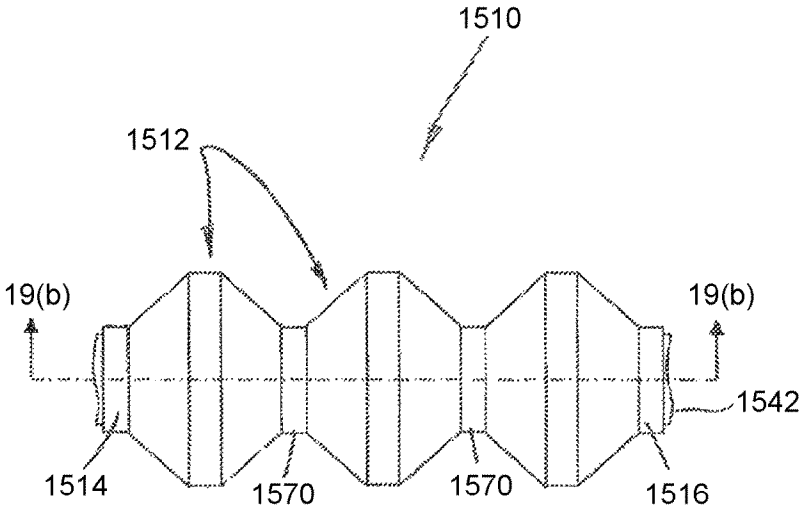
FIG. 19(*a*) is an illustration of an extendable apparatus constituting an embodiment of the present invention, shown in a retracted configuration.
Figure 19B:
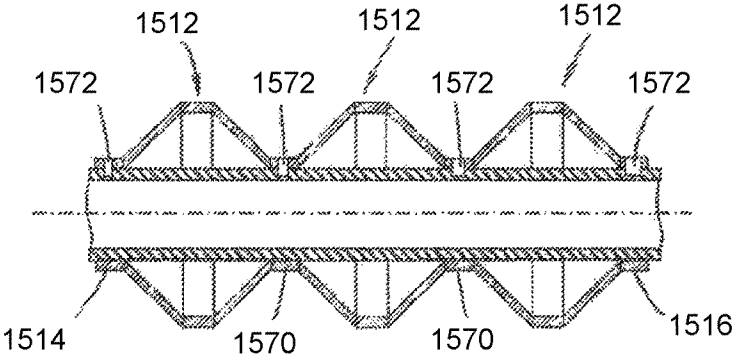

FIGS. 19(*a*) and 19(*b*) illustrate an embodiment of a laterally extendable apparatus generally designated 1510 in use in a retracted configuration mounted on an inner tubular member 1542. The apparatus 1510 comprises a plurality of identical segments 1512 extending between left and right collars 1514 and 1516 respectively. The extendable apparatus 1510 further comprises intermediate collars 1570. Each collar 1514, 1516 and 1570 is fitted with a shear pin 1572. Each shear pin 1572 is configured to shear at a different shearing force. For example, as shown in FIG. 19(*b*), the diameters of the shear pins 1572 increase from the left collar 1514 to the right collar 1516 such that the shear pins 1572 shear from left to right on the application of an axial compression force to the apparatus 1510. Such an arrangement provides a sequential release of each segment 1512 from the tubular member 1542 from the left collar 1514 to the right collar 1516 thus providing for sequential lateral extension of each segment 1512 one-by-one.

Figure 20:
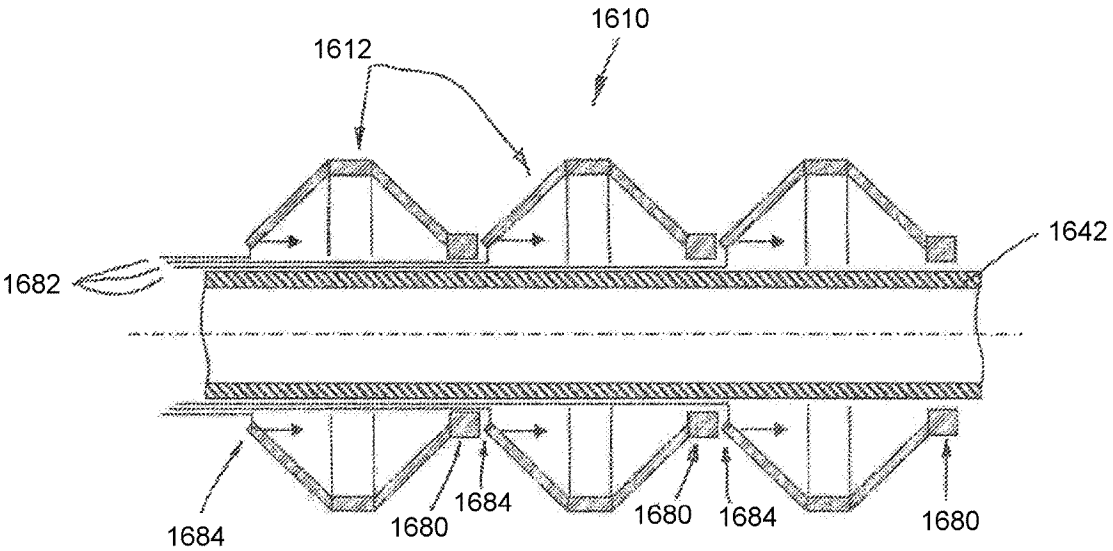
FIG. 20 is a longitudinal cross-section of an extendable apparatus constituting an embodiment of the present invention, shown in a retracted configuration.

FIG. 20 illustrates a further embodiment of a laterally extendable apparatus generally designated 1610 in use in a retracted configuration mounted on an inner tubular member 1642. The apparatus 1610 comprises a plurality of identical segments 1612. In contrast to the foregoing embodiments, one end 1680 of each segment 1612 is secured to the inner tubular member 1642 and the apparatus 1610 further comprises one actuation sleeve 1682 connected to an opposite end 1684 of each segment 1612 for the application of an axial force thereto. Each actuation sleeve 1682 is independently movable under the action of a corresponding actuator (not shown) so as to permit the sequential lateral extension of the corresponding segment 1612.

Figure 21:
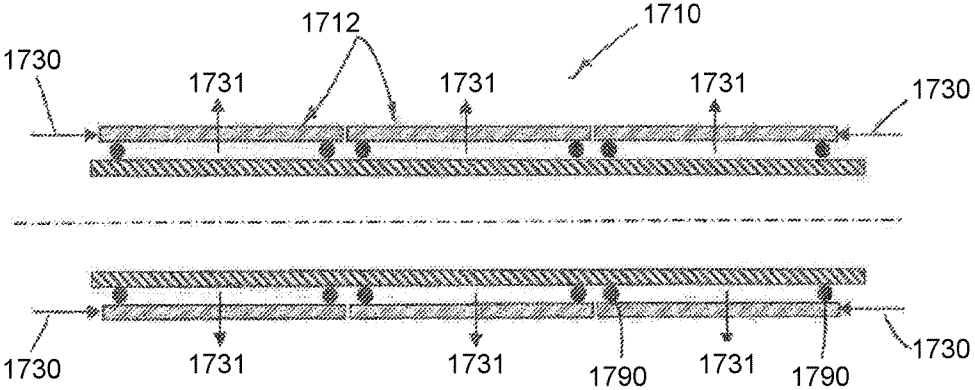
FIG. 21 is a longitudinal cross-section of an extendable apparatus constituting another embodiment of the present invention, shown in a retracted configuration.

FIG. 21 illustrates another embodiment of a laterally extendable apparatus generally designated 1710 in use in a retracted configuration mounted on an inner tubular member 1742. The apparatus 1710 comprises a plurality of identical generally cylindrical segments 1712. Each segment 1712 is generally deformable for the outward lateral extension thereof under the combined action of an axial compression force 1730 and an outward lateral force 1731. The outward lateral force 1731 may, for example, be applied using a pressurised and/or a compressed fluid. Different segments 1712 may be provided with pressurised fluid at different fluid pressures to ensure sequential lateral extension of the segments 1712. Each segment 1712 is provided with a pair of annular seal members 1790 so as to isolate the fluid used to apply the outward lateral force 1731 to the segment 1712 from the fluid used to apply the outward lateral force 1731 to adjacent segments 1712.

It should be understood that the embodiments described herein are merely exemplary and that various modifications may be made thereto without departing from the scope of the invention. For example, in each of the embodiments described the segments are configured to be laterally outwardly extendable. However, in other embodiments the segments may be laterally inwardly extendable. In some embodiments the segments may covered, for example by a sheath, sleeve or the like. In some applications, an apparatus having multiple segments, such as apparatus 10 may be used to establish a variable flow profile within a flow path.

The invention claimed is:

1. An apparatus for use in a fluid conduit, the apparatus comprising:

a plurality of segments arranged along a longitudinal axis, each of the plurality of segments comprising an extendable structure extendable in a lateral direction relative to the longitudinal axis;

wherein the apparatus is configured for a sequential actuation of lateral extension of the extendable structures of at least two of the plurality of segments by application of an axial actuation force applied at or through opposing axial ends of each of the plurality of segments;

wherein the apparatus comprises a seal structure configured to be axially compressed to a sealing configuration by the sequential actuation of the lateral extension of the extendable structures of the at least two of the plurality of segments;

wherein the apparatus further comprises an incompressible deformable support or filler material disposed around or adjacent the extendable structure of at least one segment, the incompressible deformable support or filler material configured to be deformed by the sequential actuation of the lateral extension of the extendable structures of the at least two of the plurality of segments;

and wherein, in the sealing configuration, the seal structure is supported by the extendable structures of the at least two of the plurality of segments;

and wherein the incompressible deformable support or filler material is more easily deformed than a material from which the plurality of segments are formed.

2. The apparatus according to claim 1, wherein the plurality of segments are mountable on a base structure comprising at least one selected from the group consisting of a tubular, a fluid conduit, a pipe, production tubing, liner tubing, a casing and a mandrel, and wherein the apparatus is operable within an annulus defined by the base structure and the fluid conduit which surrounds the base structure.

3. The apparatus according to claim 1, operable to form at least one selected from the group consisting of a seal, an anchor, a supporting structure and a flow restriction in a fluid conduit.

4. The apparatus according claim 1, wherein axial compression of a segment of the plurality of segments urges the extendable structure of the segment to extend laterally.

5. The apparatus according to claim 1, wherein at least one of the plurality of segments is configured to engage a surface of a proximate object comprising a fluid conduit or a base structure.

6. The apparatus according to claim 1, wherein the apparatus is configured such that lateral extension of the extendable structure of one of the plurality of segments is completed before lateral extension of the extendable structure of a different segment of the plurality of segments begins.

7. The apparatus according to claim 1, wherein the apparatus is configured such that lateral extension of the extendable structure of one of the plurality of segments begins before lateral extension of the extendable structure of a different segment of the plurality of segments ends.

8. The apparatus according to claim 1, wherein different segments of the plurality of segments are structurally arranged to provide sequential initiation of lateral extension of the extendable structures of the plurality of segments.

9. The apparatus according to claim 1, wherein the extendable structures of different segments of the plurality of segments define different angles relative to the longitudinal axis of the apparatus when the plurality of segments are in a retracted configuration.

10. The apparatus according to claim 1, wherein different segments of the plurality of segments have extendable structures which define curved surfaces of varying or different curvature.

11. The apparatus according to claim 1, wherein a laterally extended segment of the plurality of segments provides support to an adjacent segment.

12. The apparatus according to claim 1, wherein at least two adjacent segments of the plurality of segments include adjacent support surfaces which provide mutual support for one another when the at least two adjacent segments of the plurality of segments are laterally extended.

13. The apparatus according to claim 1, wherein the apparatus is configured to selectively permit one or more segments of the plurality of segments to extend laterally.

14. The apparatus according to claim 1, wherein at least one of the plurality of segments comprises a retaining arrangement which is selectively configurable between a retaining state in which the at least one of the plurality of segments is retained in a retracted configuration and a non-retaining state in which the at least one of the plurality of segments is permitted to extend laterally.

15. The apparatus according to claim 14, wherein the retaining arrangement comprises a shearing arrangement.

16. The apparatus according to claim 1, wherein the incompressible deformable support or filler material is disposed between the extendable structures of at least two adjacent segments of the plurality of segments.

17. The apparatus according to claim 1, wherein the incompressible deformable support or filler material is attached to the extendable structures of at least one of the plurality of segments.

18. The apparatus according to claim 1, wherein the incompressible deformable support or filler material is locally contained around or adjacent to the extendable structures of a segment of the plurality of segments so as to prevent exposure of the incompressible deformable support or filler material to a pressurised fluid.

19. The apparatus according to claim 1, wherein the incompressible deformable support or filler material is arranged to transfer a force between an extendable structure of a segment of the plurality of segments around or adjacent to which the support or filler material is disposed and the extendable structure of an adjacent segment of the plurality of segments.

20. A method of sealing a fluid conduit, the method comprising;

providing an apparatus comprising:

a plurality of segments arranged along a longitudinal axis, each of the plurality of segments comprising an extendable structure configured for extension in a lateral direction relative to the longitudinal axis;

a seal structure;

and an incompressible deformable support or filler material disposed around the extendable structure of at least one segment, wherein the incompressible deformable support or filler material is more easily deformed than a material from which the plurality of segments are formed;

wherein the method comprises:

applying an axial actuation force to sequentially actuate extension of extendable structures of at least two of the plurality of segments of the apparatus in a lateral direction relative to a longitudinal axis along which the apparatus is arranged;

wherein during the sequential actuation of the lateral extension of the extendable structures of the at least two of the plurality of segments, the seal structure is axially compressed to a sealing configuration and the incompressible deformable support or filler material is deformed;

and wherein, in the sealing configuration, the seal structure is supported by the extendable structures of the at least two of the plurality of segments.

* * * * *